US008020297B2

(12) United States Patent
Yoshino

(10) Patent No.: US 8,020,297 B2
(45) Date of Patent: Sep. 20, 2011

(54) METHOD FOR DISASSEMBLING BOILER

(75) Inventor: Yoshihide Yoshino, Tokyo (JP)

(73) Assignee: Besterra Co., Ltd., Tokyo (JP)

( * ) Notice: Subject to any disclaimer, the term of this patent is extended or adjusted under 35 U.S.C. 154(b) by 1021 days.

(21) Appl. No.: 11/905,691

(22) Filed: Oct. 3, 2007

(65) Prior Publication Data

US 2008/0083380 A1 Apr. 10, 2008

(30) Foreign Application Priority Data

Oct. 4, 2006 (JP) ..... 2006-272537
Mar. 29, 2007 (JP) ..... 2007-087777

(51) Int. Cl.
*B21D 51/24* (2006.01)
*B21D 53/02* (2006.01)
*B23P 6/00* (2006.01)

(52) U.S. Cl. ..... 29/890.031; 29/890; 29/890.051

(58) Field of Classification Search ..... 29/890.03, 29/890.031, 890.051; 122/459, 460, 466
See application file for complete search history.

(56) References Cited

U.S. PATENT DOCUMENTS

2009/0044766 A1* 2/2009 Yoshino ..... 122/4 R

FOREIGN PATENT DOCUMENTS

| | | | |
|---|---|---|---|
| JP | 4-131469 | A | 5/1992 |
| JP | 10-46838 | A | 2/1998 |
| JP | 11-270154 | A | 10/1999 |
| JP | 2001-329700 | A | 11/2001 |
| JP | 2003-049548 | A | 2/2003 |
| JP | 2003-301617 | A | 10/2003 |

* cited by examiner

*Primary Examiner* — David Bryant
*Assistant Examiner* — Alexander P Taousakis
(74) *Attorney, Agent, or Firm* — Birch, Stewart, Kolasch & Birch, LLP

(57) ABSTRACT

A method for disassembling a boiler supported and suspended by a supporting structure which includes the steps of cutting off a lower part of a furnace unit to provide an enlarged opening; fixing a first support to the furnace unit at approximately same height as a lower end of a heat recovery area; fixing a second support to the lower end of the heat recovery area; providing a first jacking apparatus and a second jacking apparatus under the first support and the second support, respectively; detaching the boiler from the suspending structure; lowering the first support and the second support by the first jacking apparatus and the second jacking apparatus, cutting a lower part of the boiler, repeating the lowering and the disassembling steps until the first support and the second support are lowered to a maximum extent; and disassembling a remaining upper part of the boiler.

14 Claims, 20 Drawing Sheets

METHOD FOR DISASSEMBLING BOILER

CROSS REFERENCE TO RELATED APPLICATIONS AND INCORPORATION BY REFERENCE

This application is based upon and claims the benefit of priorities from the prior Japanese Patent Application No. 2006-272537, filed on Oct. 4, 2006, and Japanese Patent Application No. 2007-087777, filed on Mar. 29, 2007; the entire content of which is incorporated herein by reference.

BACKGROUND OF THE INVENTION

1. Field of the Invention

The present invention relates to a method for disassembling a boiler. The present invention also relates to a method for disassembling a boiler and a boiler supporting structure, and more specifically, to a method for disassembling a large boiler and a boiler supporting structure which supports the boiler by a so-called top support method to be used in a thermoelectric power plant.

2. Discussion of the Related Art

A boiler is used, for instance, in a thermoelectric power plant, for generating steam at a high temperature and at a high pressure. The steam generated from the boiler based on a natural circulation or forced circulation system is used for obtaining energy for rotating a power-generating turbine, or the like. FIG. 19 is a diagram for explaining a large boiler 10 for use in a thermoelectric power plant. The boiler 10, which usually has a weight of more than 1000 tons, is installed by means of so-called "top support method". In top support method, a top part of the boiler 10 is supported by a large boiler building (shed) 12 substantially constructed by a steel frame including a main girder 12*c*, columns 12*a* vertically extending from the main girder, and beams 12*b* (12*b*-1 to 12*b*-9). The boiler 10 is retained in the boiler building 12 by being suspended from the main girder 12*c*. Namely, the boiler 10 is suspended from the boiler building 12 via a plurality (for example, 20 to 100) of suspension members 14. One end of the suspension members 14 connected to the main girder 12*c* and another end thereof is connected to a top part 10*a* of the boiler 10.

Generally speaking, the boiler 10 comprises a furnace unit 20 and a heat recovery area (rear heat-exchanging unit) 22. The furnace unit 20 can be a hollow structure, for instance, multi-sided hollow structure. In the furnace unit 20, fuel is burnt by ignition burners (not shown) provided on the lateral wall of the furnace unit 20. Therefore, combustion gas is generated. At the bottom part of the furnace unit 20, a hopper part 23 with a tapered wall is provided. The hopper part 23 extends from the lower end of the furnace unit 20 with the diameter being decreased downwardly. By this configuration, the hopper part 23 collects discharged substances such as ash for easily disposing the substances.

The heat recovery area 22 is provided on a lateral side of the furnace unit 20, and an upper part of the heat recovery area 22 communicates with an upper part of the furnace unit 20. The heat recovery area 22 also has a hollow tubular configuration and the vertical length of the heat recovery area 22 is shorter than that of the furnace unit 20. Namely, the lower end of the heat recovery area 22 is positioned higher than that of the furnace unit 20 in the boiler 10. Furthermore, a plurality of superheaters 24 (24-1 to 24-5), shown by a dash-dotted line, are contained in the hollow interior of the heat recovery area 22, for superheating steam.

The combustion gas generated in the furnace unit 20 flows through a route shown by arrows 200 and 202. The heat of the combustion gas is subjected to a heat exchange in the superheaters 24, so as to rotate a power-generating turbine, to produce electrical energy. The combustion gas after the heat exchange process by the superheaters 24, that is, gas having a decreased temperature passes through a gas duct 26 (shown by the long dashed double-short dashed lines) and then to an electrical precipitator (not shown). As the superheater 24, it is possible to use a superheater or economizer, including therein a pipe for carrying water or steam therethrough.

FIG. 20 is a diagram for explaining a structure of a furnace wall 27 for the furnace unit 20. The furnace wall 27, which is a part of a boiler wall, includes an outer casing 27*a* and a fire resistant material 27*b* provided on an inner surface of the outer casing 27*a* (corresponding to the inner periphery of the furnace unit 20). The outer casing 27*a* is made of a metal, and the fire resistant material 27*b* is made of a fire-resistant material. The fire-resistant material often includes asbestos. Further, the fire-resistant material can be replaced by an insulating material for thermal control which is cheaper than the fire-resistant material. On an inner side of the fire resistant material 27*b*, heat exchange pipes 27*c* are provided for transporting a liquid or steam therein. By the provision of the heat exchange pipes 16, a heat exchange operation is carried out also on the furnace wall 27. Moreover, it is possible that an inner casing made of a metal is further provided on a fire resistant material 27*b* on the opposite side with respect to the outer casing 27*a*. Further, the heat recovery area 22 frequently includes a heat recovery wall made of a fire resistant material.

In the above described boiler system, it is sometimes necessary to disassemble the boiler and the additional facilities, because of the deterioration, increase of maintenance fee by the deterioration, or the lowered energy conversion efficiency. However, large boiler 10 to be disassembled has a height of about 25 m to 60 m, and is suspended from the boiler buildings 12. Therefore, disassembling operation with respect to the boiler 10 and the boiler building 12 is more difficult, comparing to the disassembling operation with respect to other buildings directly provided on the ground. Accordingly, several disassembling methods have been proposed.

For example, Japanese Kokai Publication 11(2001)-270154 discloses a method for dismantling a boiler and a boiler shed, wherein the boiler is dismantled from the lower part, and the boiler shed is dismantled from the upper part. More precisely, the dismantling method in the publication comprises five steps. In the first step A, jacks are provided on both ends of a beam (top girder) which suspends the boiler (FIG. 2 in the publication). In the subsequent step B, hanging members such as wires, which extend from the jacks, are hooked on the top girder (FIG. 4 in the publication). Then, the top girder is cut from the boiler shed in step C so that parts of the top girder which support the jacks remains on the shed and other part of the top girder which the boiler is suspended from is separated from the shed (FIG. 6 of the publication). Accordingly, the boiler is suspended from the jacks provided on the boiler shed via the top girder and the hanging members of the jacks. In the following steps D and E, the boiler supported by the top girder is lowered by the jacks, and the boiler is cut from the bottom thereof (FIGS. 7 and 8 in the publication). In the dismantling method, the boiler shed is disassembled from the top in the following step F, after completing the above steps A to E for disassembling of the boiler.

In addition to the above, another method for disassembling a boiler is disclosed in Japanese Kokai Publication 2003-301617. In this method, the boiler is supported by an ascent-descent stage which is suspended by jacks provided on the top of the boiler shed. Here, the boiler is cut from the lower part to give cut parts in the form of blocks, and the cut parts are transferred by the ascent-descent frame, to a disassembling field prepared on the ground. The operational steps are repeated until the boiler is completely disassembled.

The boiler 10 to be disassembled usually has the superheaters 24 in the form of bending pipes therein, and the heat exchange pipes are provided in an inner casing of the boiler 10. Steam in the pipes is superheated to an extremely high temperature by the heat generated in the boiler 10. Therefore, it is necessary to start a disassembling operation after confirming that the temperature and pressure in the pipes.

In the method disclosed in Japanese Kokai Publication 11(2001)-270154, the entire weight of the boiler is supported by the jacks provided on the top girder of the boiler shed. Then, the boiler is gradually lowered in the state where the boiler is suspended from the top girder by use of the jacks, and the boiler is cut little by little. Such operation could be dangerous in some circumstances, sine the jacks are operated (lowered) while supporting the weight of the large portion of the top girder and the boiler.

Moreover, in accordance with the method of Japanese Kokai Publication 11(2001)-270154, it is necessary to completely disassemble the boiler in the first place, and that the boiler shed is disassembled from the top thereof, subsequently. Namely, the boiler and the boiler supporting structure are separately disassembled in the different steps. Thus, it takes a long time to perform both steps successively.

Moreover, it is necessary to carry out a pretreatment and aftertreatment each in the steps for disassembling the boiler and the step for disassembling the boiler supporting structure. Therefore, the method includes complicated procedures.

Furthermore, operations at a high place is required for the above discussed steps A to C for providing jacks, and for the step F for disassembling the boiler shed. Therefore, the method includes a dangerous disassembling step.

As to the method disclosed in Japanese Kokai Publication 2003-301617, a cut part of the boiler is conveyed by using the descent-ascent frame. Therefore, the method needs not suspend the entire boiler. In Japanese Kokai Publication 2003-301617, however, the ascent-descent stage has to be suspended from the jacks on the boiler shed. In a practical point of view, it is difficult to perform the method because the space around the boiler, particularly around the furnace unit which contains many attachments such as a control floor and piping that could be obstacles for the operation. Accordingly, it is very difficult to set the jacks on the top of the boiler shed so that a member for suspending the stage does not interfere with the attachment of the boiler.

SUMMARY OF THE INVENTION

It is therefore an object of the present invention to provide a method for disassembling a boiler supported by a supporting structure, the boiler comprising a furnace unit and a heat recovery area arranged in parallel with the furnace unit, both the furnace unit and the heat recovery area extending in a vertical direction and a lower end of the furnace unit being situated lower than a lower end of the heat recovery area, which can be carried out safely, easily and speedily, without a dangerous operation with an unstable suspended support/stage, in a limited space such as a space between the boiler and the supporting structure around the boiler, or at a high place.

The method comprises: an enlarged opening forming step for cutting off a lower part of the furnace unit to prepare an enlarged opening in the furnace unit; a first support installation step for fixing a first support to the furnace unit approximately at the same height as the lower end of the heat recovery area; a second support installation step for fixing a second support to the lower end of the heat recovery area; a boiler supporting step for providing a first jacking apparatus and a second jacking apparatus respectively under the first support and the second support so that the entire weight of the boiler is supported by the first jacking apparatus and the second jacking apparatus via the first support and the second support; a suspension state cancellation step for detaching the boiler from the suspending structure; a lowering and disassembling step for lowering the first support and the second support by the first jacking apparatus and the second jacking apparatus, and cutting a lower part of the boiler, the lowering and the disassembling step being repeated until the first support and the second support are lowered to a maximum extent; and a remainder disassembling step for disassembling a remaining upper part of the boiler with the boiler being maintained on the first support and the second support.

According to the method of the present invention, the boiler which has been cut off from the supporting structure, can be supported from a lower side by the jacks, and the suspending operation for supporting the cut off boiler is eliminated. In the remainder disassembling step, the remaining upper part of the boiler has already been lowered to a height which is close to the ground. Therefore, the remaining upper part can be easily disassembled by a heavy machine from the top. Namely, the disassembling to the upper part of the boiler is carried out in the same way as for a building.

In the method of the invention, it is preferable that each of the first support and the second support has a lattice configuration made by interconnecting support bars (garder, H-shaped or I-shaped steel material). Accordingly, each of the first or second supporting apparatuses can support a single bar in the first or the second support. The support force applied to the single bar is distributed to other bar(s) which extend across the bar. Accordingly, the first and second supports stably support the entire weight of the boiler.

In the present invention, it is preferable that the first support and the second support are connected by a connection bar which extends over the first support and the second support.

The connected first and the second supports are supported by the first and the second jacking apparatus effectively, and the entire boiler can be stably support by the connected supports.

Another object of the present invention is to provide a method for disassembling a boiler and a supporting structure, the boiler being suspended from the supporting structure, the boiler comprising a furnace unit and a heat recovery area arranged in parallel with the furnace unit, both the furnace unit and the heat recovery area extending in a vertical direction and a lower end of the furnace unit being situated lower than a lower end of the heat recovery area, which can be carried out safely, easily and speedily, without a dangerous operation with a unstable suspended support, in a limited space, or at a high place.

The method comprises an enlarged opening forming step for cutting off a lower part of the furnace unit to prepare an enlarged opening in the furnace unit; a support installation step for fixing a support to the furnace unit and the heat recovery area approximately at the same height as the lower end of the heat recovery area so that the support horizontally extends over the supporting structure; a boiler and supporting structure supporting step for providing an jacking apparatus under the support so that the entire weight of the boiler and the supporting structure is supported by the jacking apparatus via the support; a lowering and disassembling step for lowering the support by the jacking apparatus, and cutting lower parts of the boiler and the supporting structure, the lowering and the disassembling step being repeated until the support is lowered to a maximum extent; and a remainder disassembling step for disassembling a remaining upper part of the boiler and the supporting structure. It is possible that the boiler is maintained on the support in the remainder disassembling step.

According to the above method of the invention, it is possible to carry out the disassembling operation with respect to the boiler, simultaneously with the disassembling operation with respect to the supporting structure. Namely, it is not necessary to disassemble the boiler and the supporting structure successively, so that the efficiency of the disassembling operation is remarkably improved.

It is preferable in the present invention that the support has a lattice configuration made by interconnecting support bars. Instead of the single support, it is also possible to use the combined support discussed previously.

By using the support with the lattice configuration, the force for supporting a single bar is distributed to other bar(s) which extend across the bar. Accordingly, a stable support is attained with respect to the entire weight of the boiler and the boiler supporting structure.

It is also possible in the present invention to further comprise a step for providing a strut between a main girder of the supporting structure and the support, for imparting a resistance to the support against the force applied by the jacking apparatus. The strut is applicable to the above discussed method for disassembling a boiler, and the method for disassembling a boiler and a supporting structure simultaneously. It is possible to provide a plurality of struts. The strut functions as a reinforcing member, for increasing a resistance of the support against the force applied by the jacking apparatus.

A further object of the present invention is to provide a method for disassembling a boiler and a supporting structure comprising a plurality of columns extending in a vertical direction and a plurality of beams extending in a horizontal direction for interconnecting the columns at different heights, the boiler being included in the supporting structure and suspended therefrom, the boiler being connected to external equipment provided around the supporting structure by a connection thereto, wherein the boiler and the supporting structure can be disassembled almost at the same time, with the support from lower parts of the boiler and the supporting structure.

The method comprises a detaching step for cutting the connection so as to separate the boiler and the supporting structure from the external equipment; an installation step for providing a plurality of first jack apparatuses below the columns and the beams of the supporting structure; a supporting step for supporting the boiler and the supporting structure with the first jacking apparatuses at a first supporting height, the boiler and the supporting structure being supported from lower parts of the boiler and the supporting structure; an removal step for cutting parts of the boiler and the supporting structure which are lower than the first supporting height, with the boiler and the supporting structure being stably supported; and a lowering step for lowering the boiler and the supporting structure by the first jacking apparatuses from the first supporting height after completing the removal step, the supporting step, the removal step and the lowering step being repeated as a recurrent operation for successively disassembling the boiler and the supporting structure from the lower parts of the boiler and the supporting structure. The columns and the beams of the supporting structure can be made of steel.

According to the above described method, it is not necessary to disassemble the supporting structure after completing the disassembling operation of the boiler. Therefore, the period of time required for disassembling both the boiler and the supporting structure is minimized. Moreover, the removal step is carried out from lower parts of the boiler and the supporting structure, i.e., at a height close to the ground (base surface). Since operation at high place is not included in the method of the present invention, the disassembling operation is safely carried out. Moreover, the removed parts (cut parts) of the boiler and the supporting structure can be easily conveyed from the low level. The disposal operation is speedily performed.

It is possible that the first jacking apparatuses comprise extendable parts which extend and contract in a vertical direction. The boiler and the supporting structure can be supported by increasing the length of the extendable parts and pressing upper ends of the extendable parts against lower surfaces of the columns and the beams of the supporting structure.

It is also possible that the supporting step in the recurrent operation is carried out by providing a plurality of second jacking apparatuses at a plurality of positions, for supporting the boiler and the supporting structure at a second supporting height higher than the first supporting height.

The first jacking apparatuses or the second jacking apparatuses can support the boiler and the supporting structure. By using two groups of jacking apparatuses alternately, the supporting step, lowering step, and removal step are smoothly carried out in turn, and the boiler and the supporting structure are stably supported. Further, the disassembling operation is safely carried out.

It is also possible that the supporting step in the recurring operation comprises a first substep for removing lower parts of the boiler and the supporting structure which are supported by at least some of the first jacking apparatuses, to provide bottom edges of the boiler and the supporting structure which are not supported by the portion of the first jacked apparatuses, and a second substep for supporting the bottom edges of the boiler and the supporting structure by increasing the length of the extendable parts of said at least some of the first jacking apparatuses, the first substep and the second substep being repeated until all the jacking apparatuses are involved in the first substep and the second substep, and subsequently the removal step and the lowering step bring repeated. Here, it is preferable that some (not all) of the jacking apparatus is used in a single first substep and following single second substep.

In this case, only a single kind of jacking apparatuses (first jacks), which has been installed in an earlier step, is used in the following steps. For example, some of the jacking apparatuses is used in the supporting step in the recurrent operation, and then some other of the jacking apparatuses is used in the supporting step, for gradual increasing the height for supporting the boiler and the supporting structure. Therefore, it is not necessary to install other kind of jacks in the course of the disassembling operation. As a result, the method for disassembling the boiler and the supporting structure of the present invention is smoothly carried out.

It is preferable in the present invention that the interior of the boiler is set to a negative pressure prior to the removal step.

When the removal step is carried out with setting the interior of the boiler to a negative pressure, cut substances such as metal or fire-resistant material, for instance in the form of powder, obtained by cutting the boiler are not released to the exterior of the boiler, and absorbed into the interior thereof. Accordingly, it is possible to prevent environmental problems from occurring in the removal step. For setting a negative pressure, it is possible to evacuate air from the boiler through a pipe.

BRIEF DESCRIPTION OF THE DRAWINGS

A more complete appreciation of the invention and many of the attendant advantages thereof will be readily perceived as the same becomes better understood by reference to the following detailed description when considered in connection with the accompanying drawings, wherein.

DETAILED DESCRIPTION OF THE INVENTION

Other features of this invention will become apparent in the course of the following description of exemplary embodiments, which are given for illustration of the invention and are not intended to be limiting thereof.

Exemplary embodiments of the present invention will now be explained by referring to figures.

First Embodiment

Figure 19:
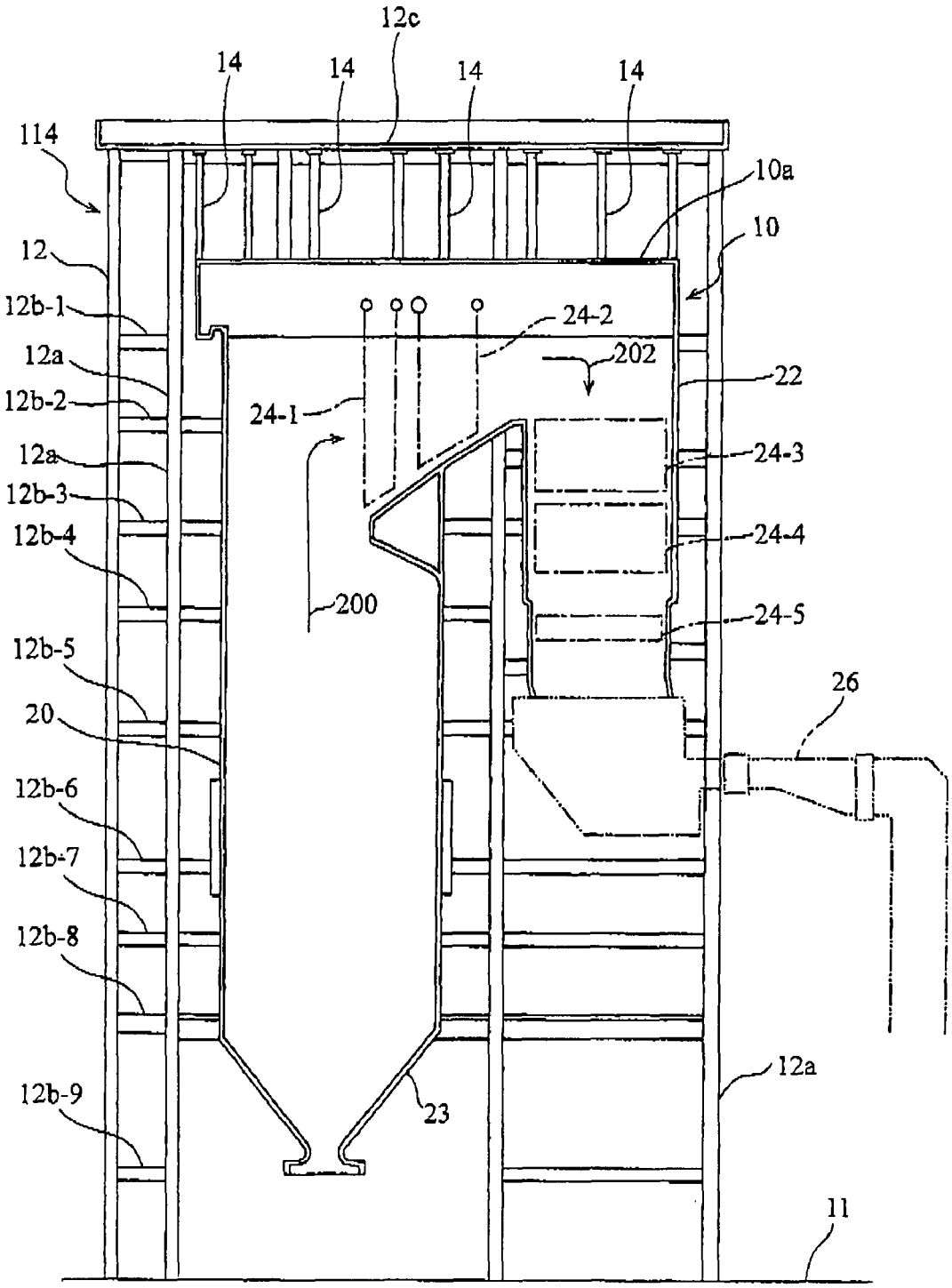
FIG. 19 is a diagram for explaining a large boiler for use in a thermoelectric power plant.
Figure 20:
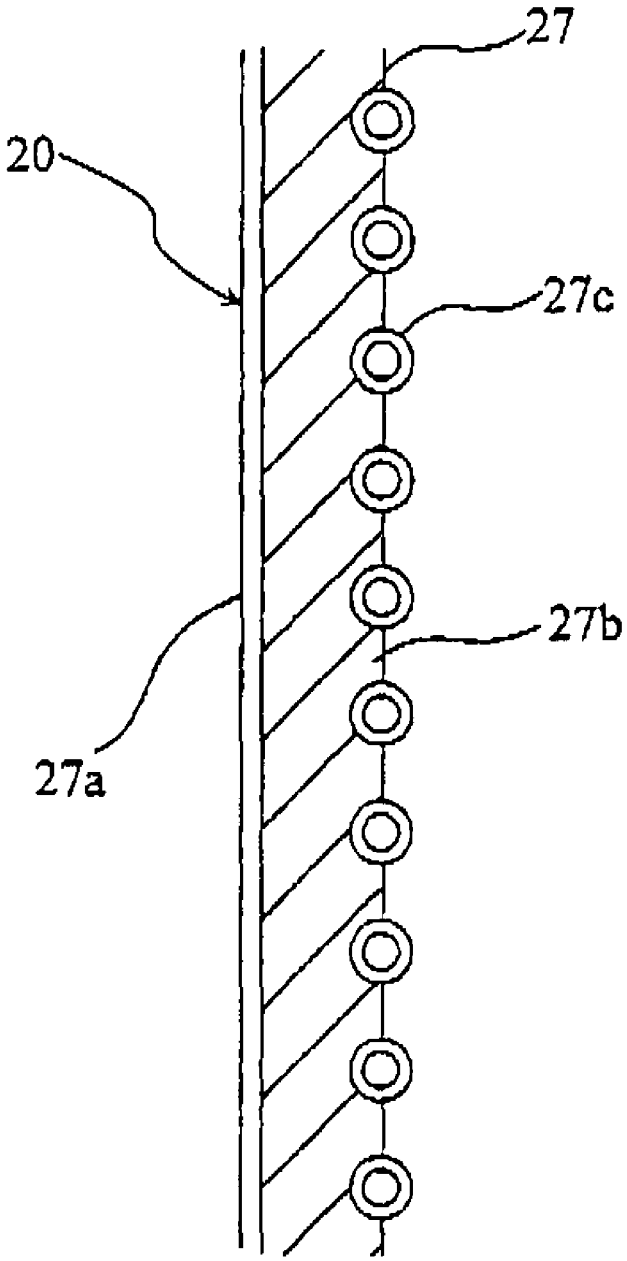
FIG. 20 is a diagram for explaining a furnace wall in the furnace unit.

FIGS. 1 to 5 are schematic diagrams for explaining a method for disassembling a boiler according to the present invention. In the figures, the explanation of the reference numerals is omitted, for the structures which are the same as those in the previously explained FIG. 19. The gas duct 26 in FIG. 19 has already been removed in FIGS. 1 to 5. Further, FIG. 6 is a flow-chart for explaining the steps included the method of the present invention.

Figure 1:
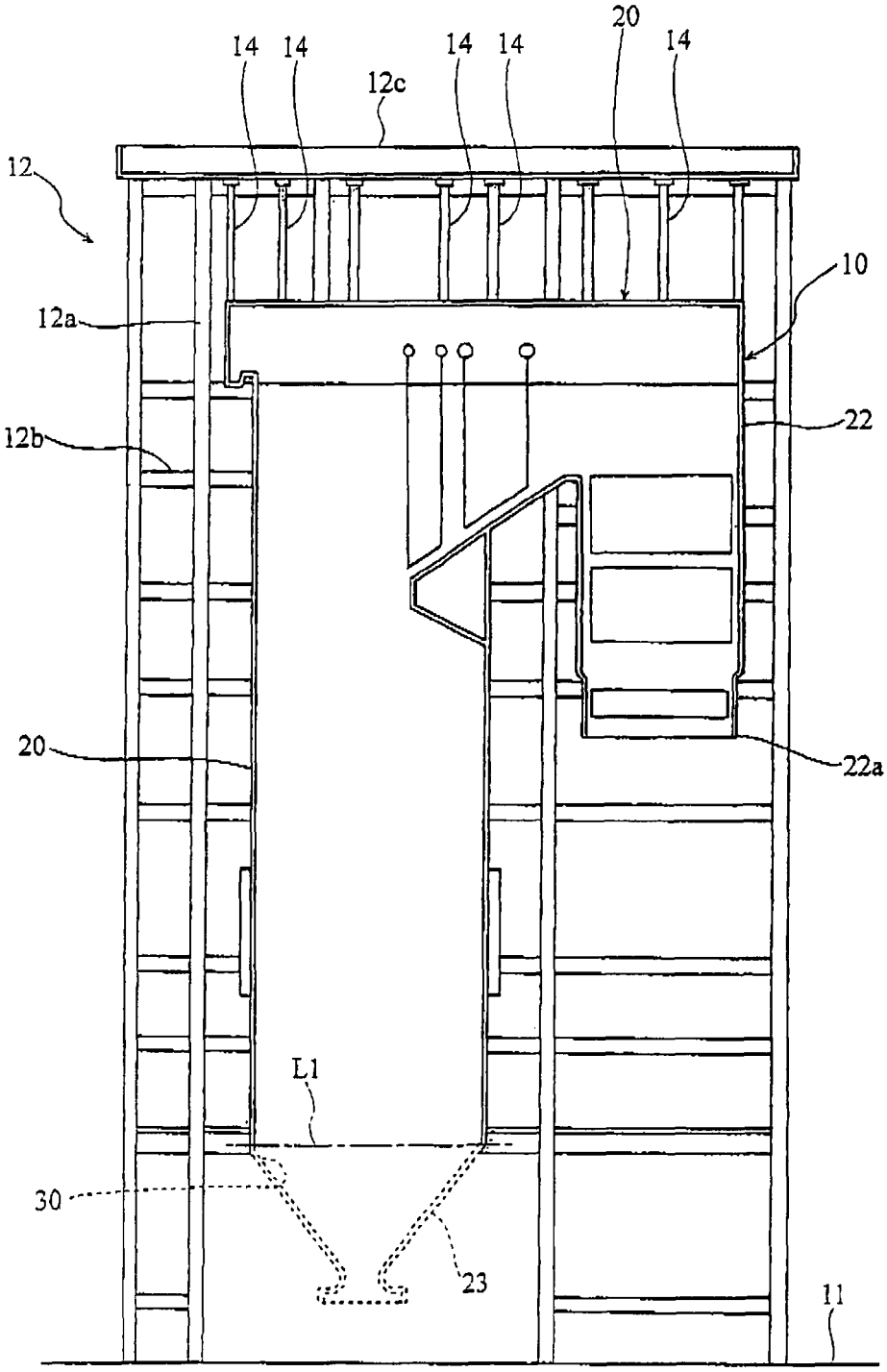
FIG. 1 is a diagram for explaining an enlarged opening forming step in a method for disassembling a boiler according to the present invention.

First, a hopper part 23 which is provided on the lower end of the furnace unit 20 is cut off along dash-dotted line L1 in FIG. 1, to form an enlarged opening 30 in the furnace unit 20. The term "enlarged opening" refers to that an opening is formed by the cutting operation, which is larger than the opening originally prepared in the hopper part 23. This is an enlarged open forming step described as a step (hereinafter referred to as "S") 101 in FIG. 6. The hopper part 23 can be easily cut off by using a cutting member such as a gas burner or a torch.

Figure 2:
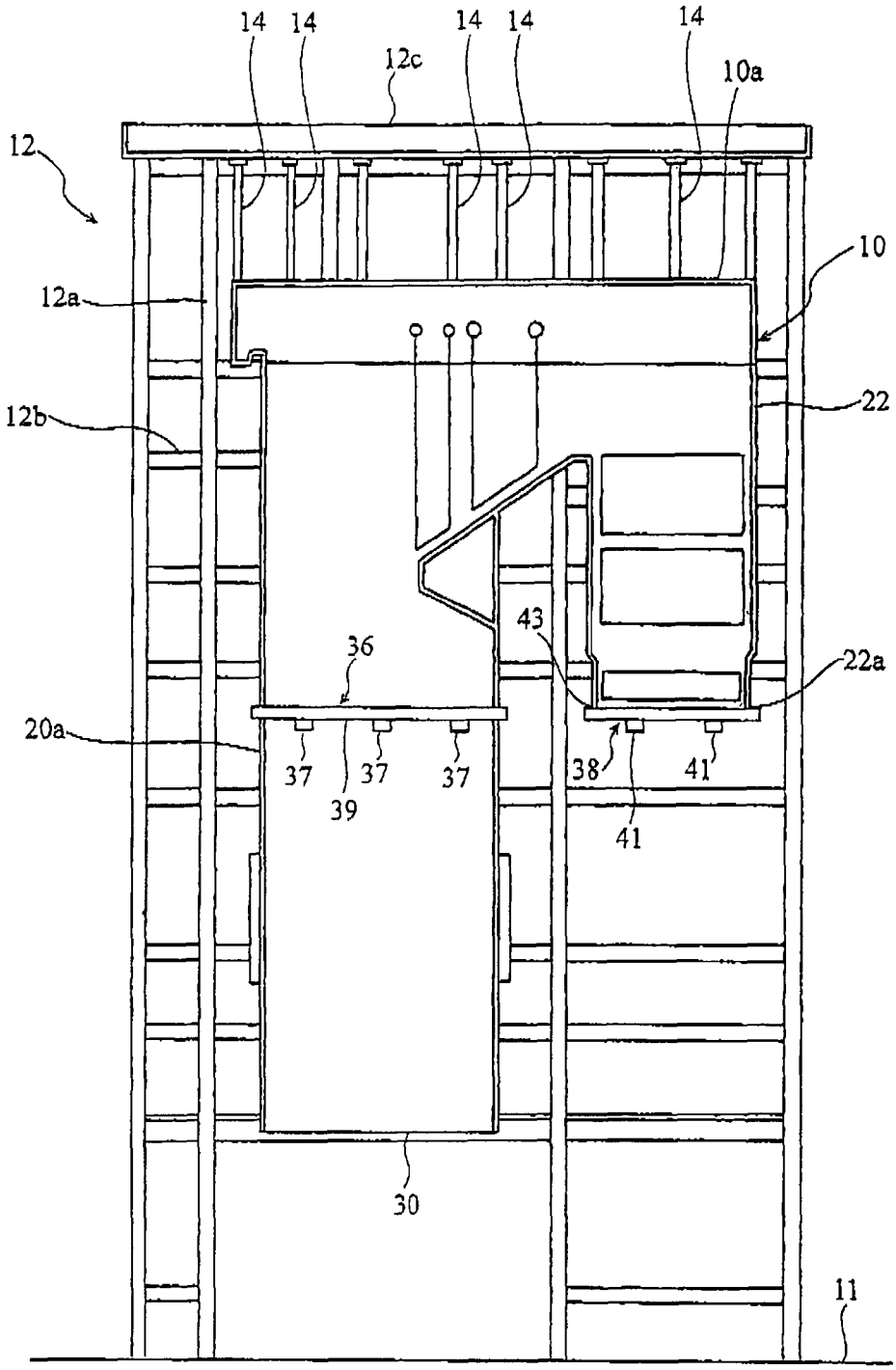
FIG. 2 is a diagram for explaining a first support installation step and a second support installation step in a method for disassembling a boiler according to the present invention.

An operator enters into the furnace unit 20 from the enlarged opening 30 by using a machine such as a lift (not shown). Then, the operator installs a first support (rack support) 36 in the furnace unit 20 at a height which is approximately the level of the lower end of the heat recovery area 22 as shown in FIG. 2. This step corresponds to a first support installation step indicated as S102 in FIG. 6.

Figure 7B:
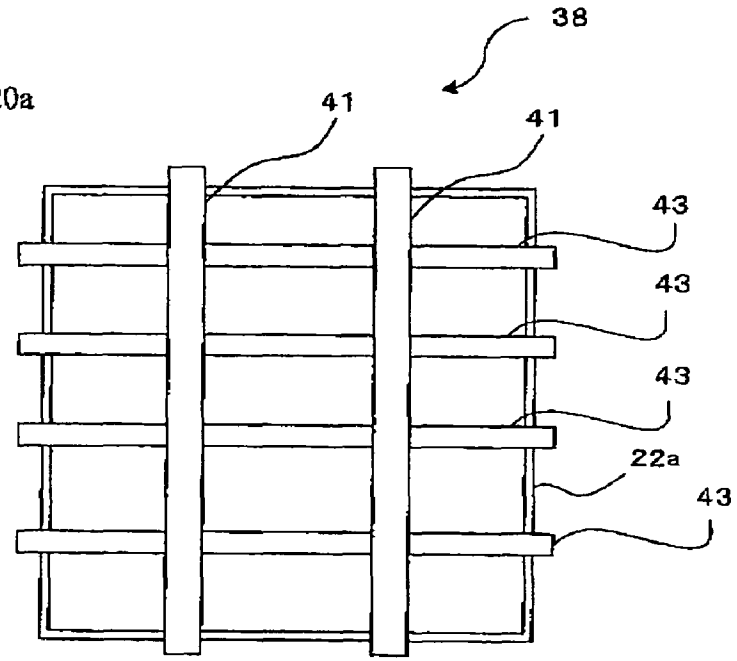
FIG. 7B is a diagram for explaining a configuration of a second support to be used in a method for disassembling a boiler according to the present invention.
Figure 7A:
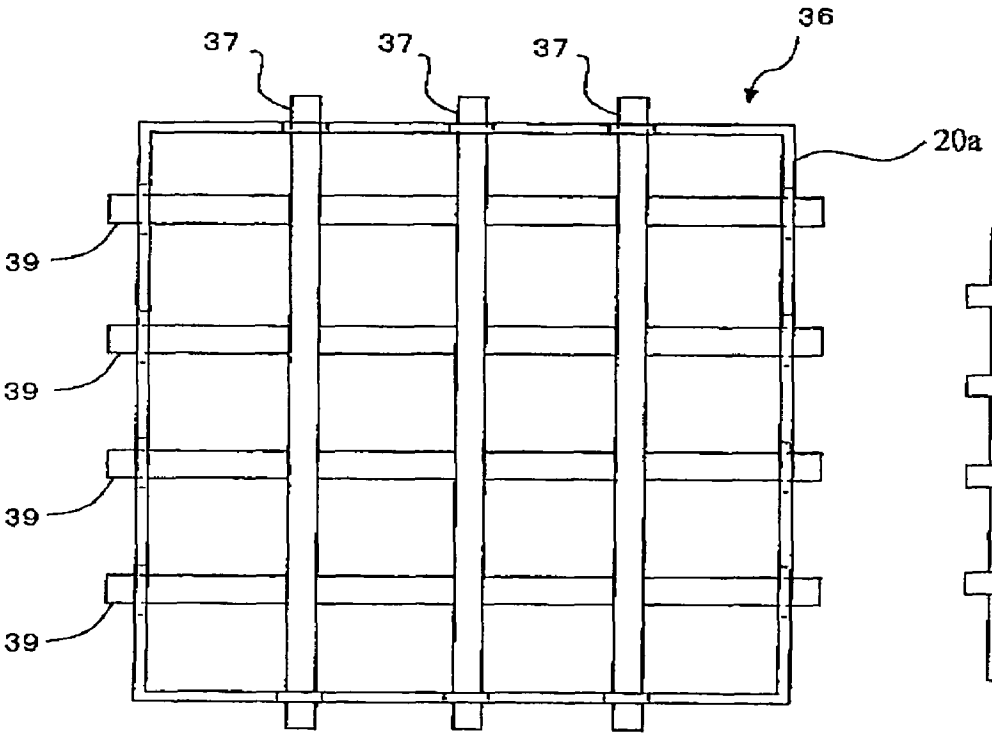
FIG. 7A is a diagram for explaining a configuration of a first support to be used in a method for disassembling a boiler according to the present invention.

As shown in a schematic bottom view in FIG. 7A, the first support 36, for example, comprises three support bars 37 which extend in parallel with each other, and four other support bars (beams) 39 which extend in a perpendicular direction with respect to the bars 37. The bars 37 and 39 are made of rigid materials such as steel, and welded with each other at the crossing point. Thus, the first support 36 is configured as a lattice. The number of bars 37 and 39 are not limited to the above.

The first support 36 is provided in the furnace unit 20 so that each of the support bars 37 and 39 penetrates the furnace wall 27. The bars 37 and 39 are welded to the furnace wall 27 for fixing the first support 36 to the furnace unit 20.

For welding the bars 37 and 39 to the furnace wall 27, the operator can go up to a position where the first support 36 is to be installed by riding on an apparatus for high-spot operations such as a lift or a gondola. Examples of these apparatus include machines which can go through a narrow opening, as disclosed in Japanese Kokai Applications 11(2001)-50651 and 11(2001)-131789. In the present invention, however, the enlarged opening 30 is prepared in the furnace unit 20. Therefore, the operator and the support 36 can be easily conveyed to the height for the operation.

As a second support installation step at S103 in FIG. 6, a second support (rack support) 38 is provided at a lower end 22*a* of the heat recovery area 22 (second support installation step).

As shown in a schematic view in FIG. 7B, the second support 38, for example, comprises support bars 41 which extend in parallel with each other, and other support bars (beams) 43 which extend in a perpendicular direction with respect to the bars 41. For assembling the second support 38, the bars 43 are welded to the bottom end 22*a* of the heat recovery area 22. Then, the bars 41 are welded to the lower surface of the bars 43 so that the bars 41 and 43 are arranged perpendicularly with each other.

Figure 3:
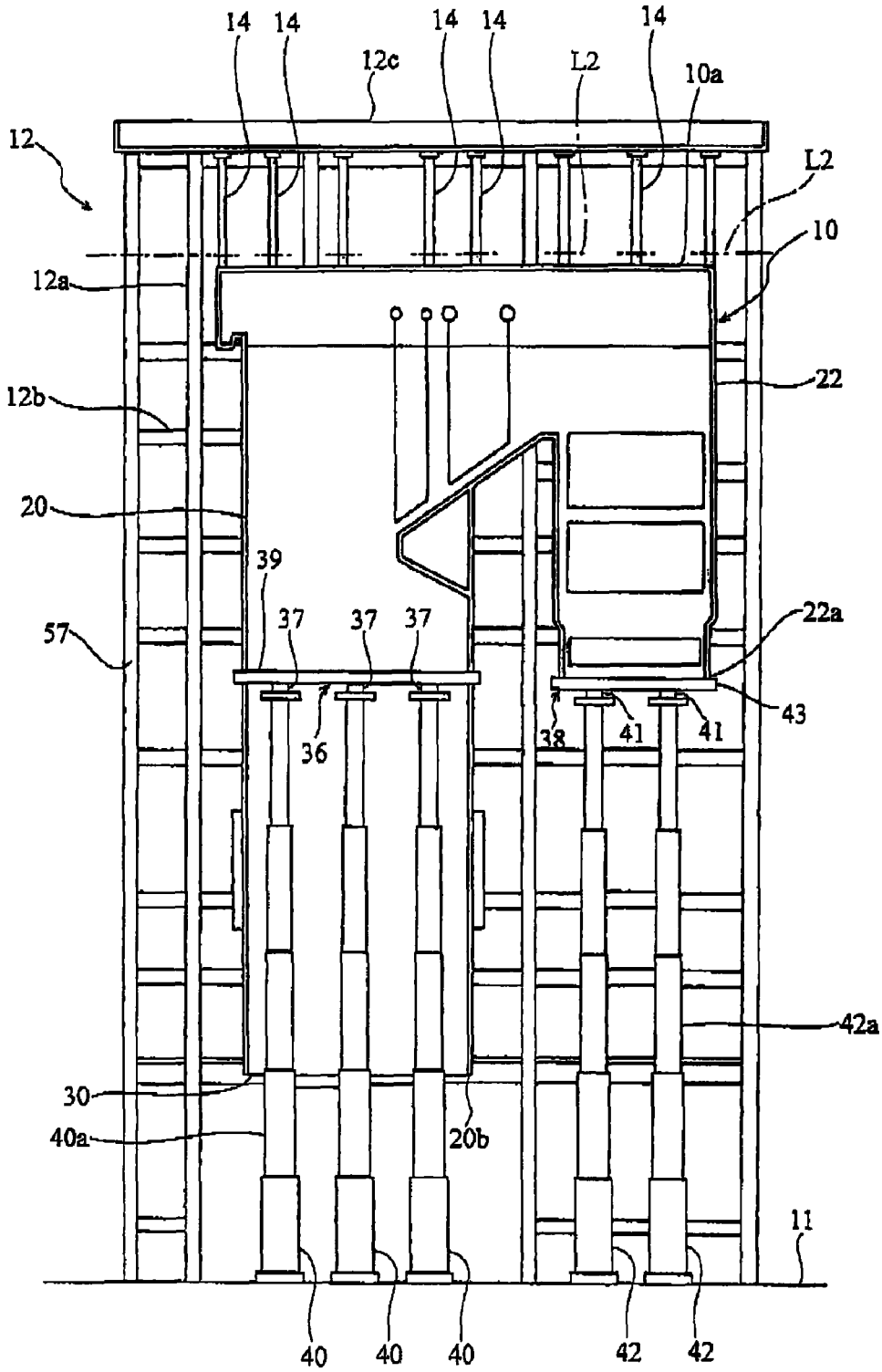
FIG. 3 is a diagram for explaining a boiler supporting step in a method for disassembling a boiler according to the present invention.
Figure 4:
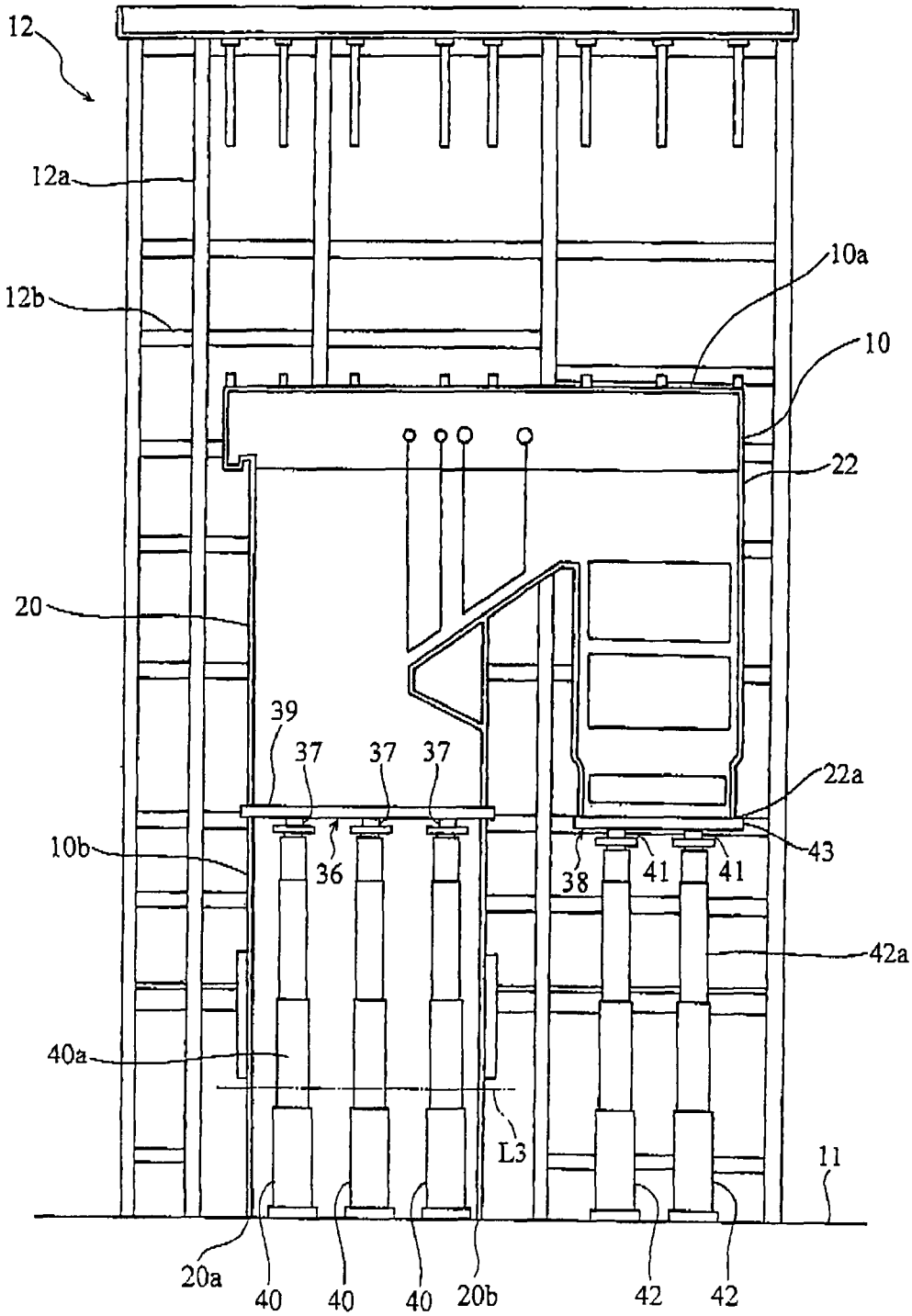
FIG. 4 is a suspension state cancellation step and a lowering and disassembling step in a method for disassembling a boiler according to the present invention.

A boiler supporting step is described in S104 in FIG. 6, and FIG. 3. As shown in FIG. 3, jacks 40 as first jacking apparatuses and jacks 42 as second jacking apparatuses are provided under the enlarged opening 30 of the furnace unit 20 and the heat recovery area 22, via the first and the second supports 36 and 38, respectively. The jacks 40 and 42 respectively have extendable parts 40*a* and 42*a* which extend in a longitudinal direction of the jacks, i.e. a vertical direction when installed as in FIG. 3. The length of the extendable parts 40*a* and 42*a* is increased for appropriately supporting the first and the second supports 36 and 38 (boiler supporting step). More specifically, the jacks 40 and 42 are contacted with the lower surfaces of the support bars 37 and 41 in the first and second supports 36 and 38, by increasing the length of the extendable parts 40*a* and 42*a* In this way, the weight of the boiler is supported by the jacks 40 and 42 via the supports 36 and 38.

The extendable parts 40*a* and 42*a* are configured as telescopic forms which are prepared from hollow cylinders with different diameters. The cylinders can have a layered/contraction structure by inserting one cylinder to another. By using an apparatus such as a hydraulic machine, the lengths of the extendable parts 40*a* and 42*a* are increased by upwardly bringing a cylinder with a small diameter with respect to a cylinder with a large diameter provided at a lower position. As a result, the jacks 40 and 42 are extendable in a vertical direction so as to have a length of about several tens meters. FIG. 3 describes an embodiment to use three jacks 40 and two jacks 42. However, the number of jacks 40 and 42 is not limited to the embodiment, and can be varied depending on the weight of the furnace unit 20 and the heat recovery area 22.

Since the supports 36 and 38 have a lattice configuration as shown in FIGS. 7A and 7B, the support force of the jacks 40 and 42 is dispersed to the all the support bars 37, 39, 41 and 43 even when the jacks 40 and 42 are in contact only with the bars 37 and 41. Accordingly, the heavy boiler can be stably supported by all the bars.

In the present invention, the extendable parts 40*a* of the first support 36 is inserted in the furnace unit through the enlarged opening 30. Therefore, the furnace unit 20 can be supported without interfering with the attachment such as the control floor or piping.

Thereafter, suspending members 14, which are used for suspending the boiler 10 from the boiler building 12 (supporting structure), are cut off along dash-dotted line L2 in FIG. 3. Accordingly, the boiler 10 is detached from the boiler building 12. This operation is referred to as a suspended state cancellation step shown by S105 in FIG. 6.

The subsequent step, S106 in FIG. 6 is a lowering and disassembling step. As also described in FIG. 4, the extendable parts 40*a* and 42*a* of the jacks 40 and 42 are contracted approximately at the same time. Therefore, the boiler 10 is lowered so that the boiler lower part 10*b* are brought closer to a base surface 11 such as ground for providing the boiler building 12 thereon. Then, it is made possible for an operator on the ground to cut a part of the boiler 10. After the boiler 10 is placed at a proper height, the operator cuts the boiler 10 along dash-dotted line L3 for disassembling/removing a part lower than line L3. Thereafter, the step for lowering the boiler 10 and disassembling/removing the lower part 10*b* of the boiler 10 are repeated, until the part of the furnace unit 20, which is lower than the first support 36, is completely disassembled (lowering and disassembling step, S106).

Figure 5:
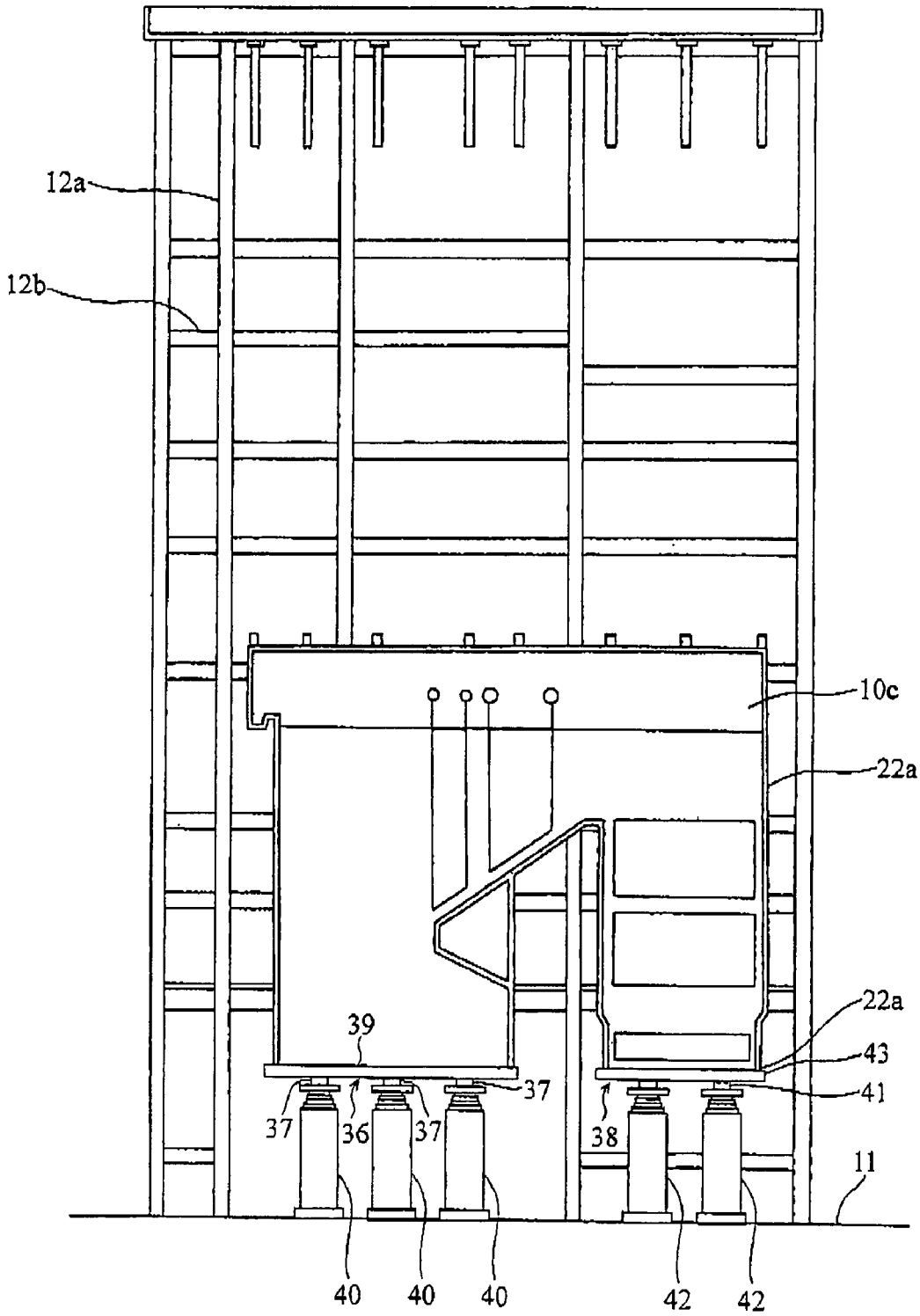
FIG. 5 is a diagram for showing an upper remaining part of the boiler after a lowering and disassembling step in the present invention.
Figure 6:
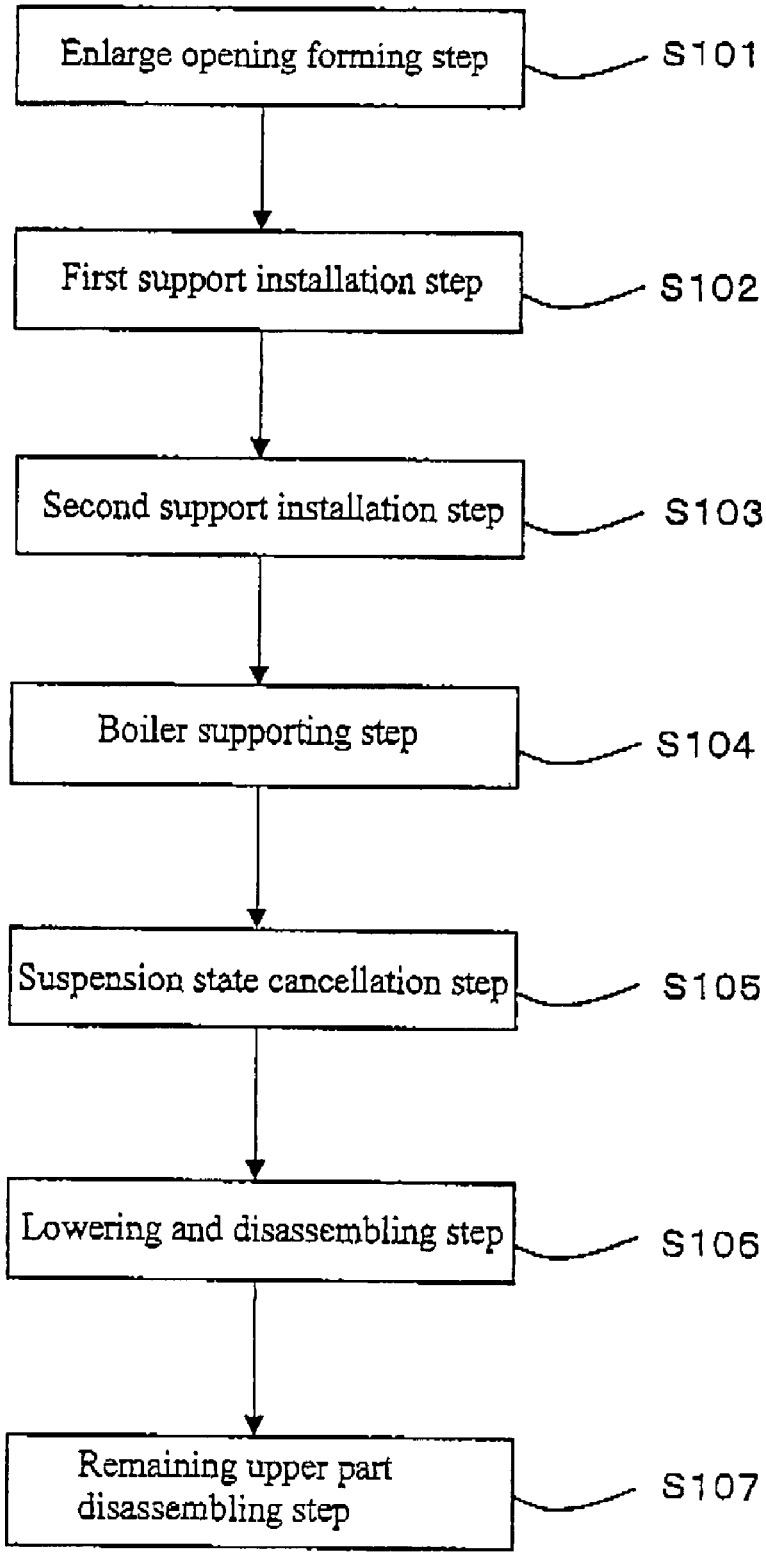
FIG. 6 is a flow-chart for explaining the steps which can be included in a method for disassembling a boiler according to the present invention.

FIG. 5 is a diagram for explaining an operation for disassembling an upper remaining part 10*c* of the boiler 10, that is a remainder disassembling step described as S107 in FIG. 6. Since the lower part 10*b* of the boiler 10 is completely disassembled in the previous step S106, the upper remaining part 10*c* of the boiler 10 can be lowered closely to the ground 11 (FIG. 5). Namely, the remaining upper part 10*c* is supported at a low level by the jacks 40 provided below the part 10*c*. As discussed previously, the upper part 10*c* of the boiler 10 is not suspended any more and is supported at a lower level. Therefore, it is possible to disassemble the upper remaining part 10*c* easily and safely, equally to the operation with respect to other structure such as a building (remainder disassembling step). For the remainder disassembling step, a heavy machine generally used for disassembling a structure directly built on the ground. Accordingly, it is possible to simplify the operation for disassembling the boiler, and hence to largely decrease the cost necessary for the operation.

When the upper remaining part 10*c* is disassembled from the exterior of the boiler building 12, it is possible to prepare an opening in the boiler building 12, which is for introducing a front attachment of the heavy machine, such as a digger of a power shovel. Such opening can be prepared by cutting some of the columns 12*a* and the beams 12*b*.

According to the method for disassembling a boiler of the invention, it is possible to remove a disassembling operation carried out by suspending the boiler. This is because the entire weight of the boiler 10 is supported by the jacks provided under the bottom part of the boiler 10. Furthermore, in the present invention, it is not necessary to use members for supporting the boiler 10 by utilizing the limited space around the boiler 10. To the contrary, the boiler 10 can be supported from the bottom by using the interior space of the furnace unit 20 in the present invention. Therefore, the disassembling operation can be smoothly carried out without interfering with the boiler attachment such as piping.

Figure 8:
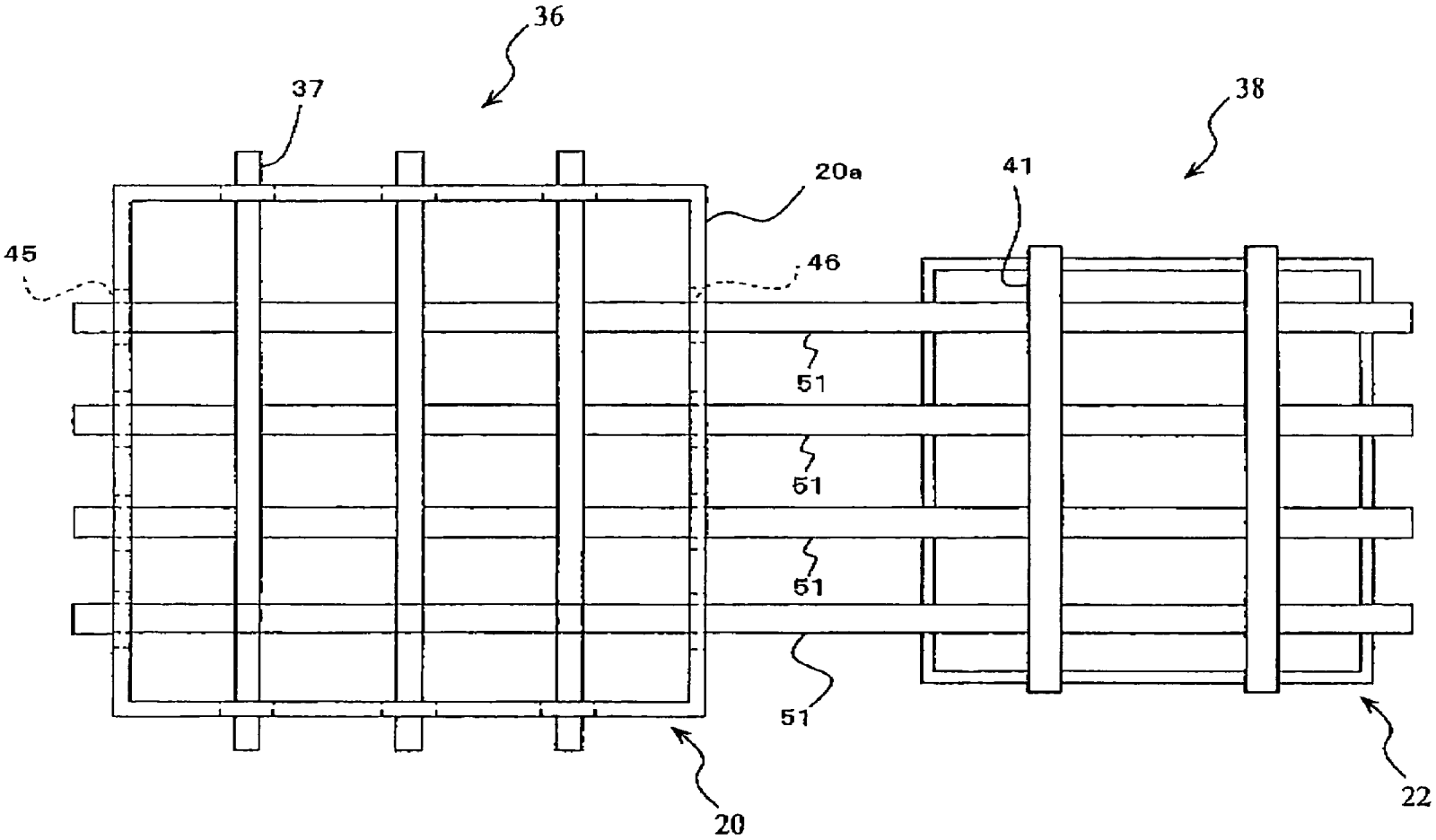
FIG. 8 is a diagram for explaining other configurations of the first and the second support to be used in a method for disassembling a boiler and/or a supporting structure according to the present invention.

FIG. 8 is a diagram for showing a modified example of the previously discussed first and second supports 36 and 38 in FIGS. 7A and 7B. In FIG. 8, the first support 36 and the second support 38 comprise the bars 37 and 41 respectively. The supports 36 and 38 comprise connection bars 51 which extend over the first support 36 and the second support 38, instead of comprising the support bars 39 and 43. When installed to the boiler, the supports 36 and 38 extend over the furnace unit 20 and the heat recovery area 22. Here, the support bars 37 and the connection bars 51 configure the first support 36, and the support bars 41 and the connection bars 51 configures the second support 37.

Figure 9:
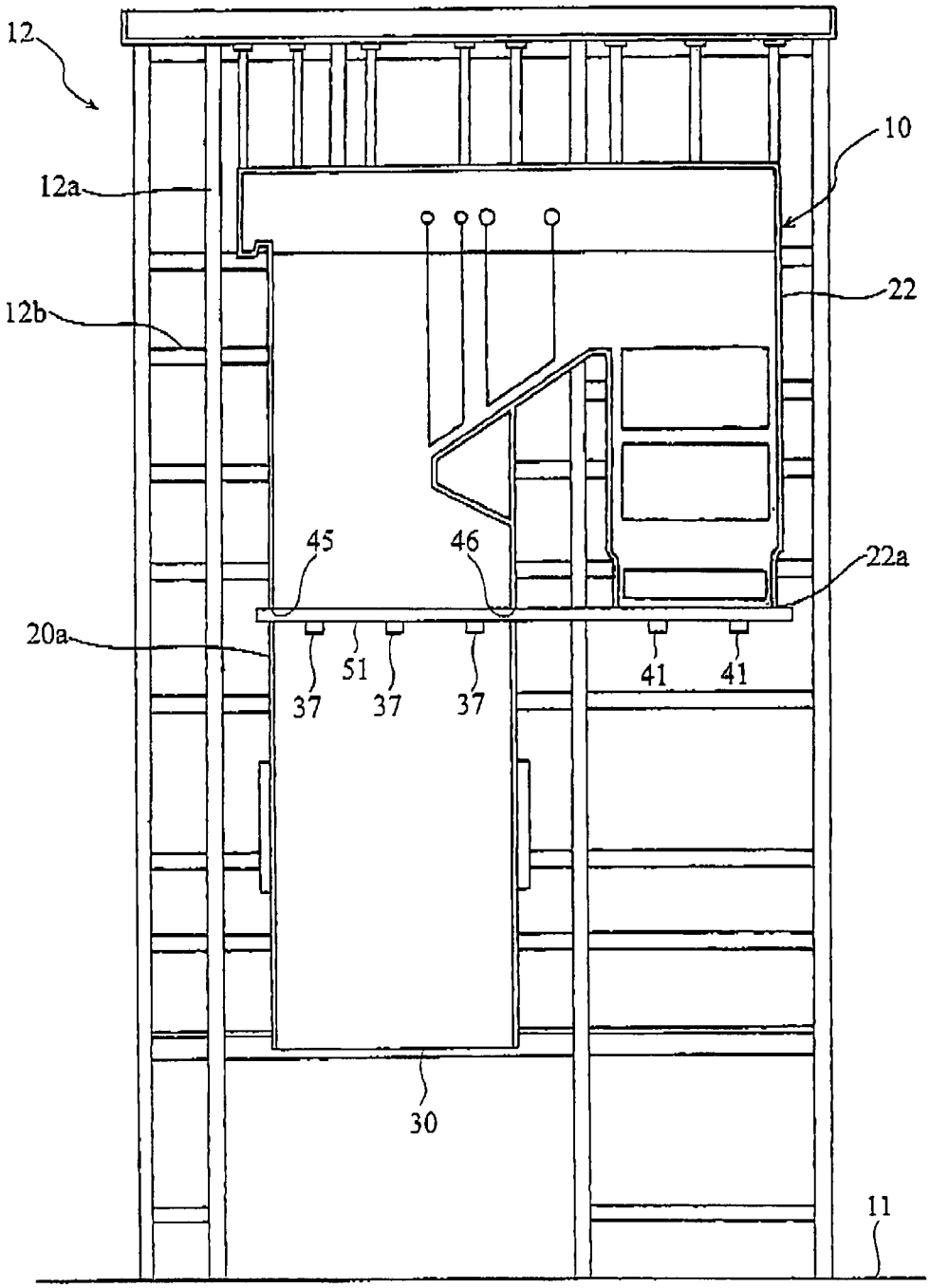
FIG. 9 is a diagram for explaining a process for installing a support to the boiler.

FIG. 9 is a diagram for explaining a process for installing a support to the boiler 10. As the support, the first support and the second support interconnected with the connection bars 51 (FIG. 8) can be used.

For performing the operation, for example, an opening (not shown) is formed in the boiler building 12 for introducing the connection bars 51. Further, a wall opening 45 is prepared in the wall 20*a* of the furnace unit 20 at a position opposing to the opening in the boiler building 12. Moreover, another wall opening 46 is prepared in the wall 20*a* at a position opposing to the wall opening 45. From the outside of the boiler building 12, the connection bars 51 are inserted to the opening in the boiler building, the wall openings 45 and 46. Therefore, the connection bars 51 reach the lower end 22*a* of the heat recovery area 22. Then, the connection bars 51 are fixed to the wall 20*a* of the furnace unit 20 and the lower end 22*a* of the heat recovery area 22, by welding. Then, the support bars 37 and 41 is welded to the connection bars 51 so as to extend in a perpendicular direction with respect to the connection bars 51.

When the support force is applied by the jacks 40 to the first support 36, the force is distributed to the second support 38. To the contrary, the support force applied by the jacks 42 to the second support 38 is distributed to the first support 36. Namely, the jacks 40 and 42 support the first and the second support 36 and 38 (FIG. 8) all together. As a result, the boiler supporting stability is increased.

Figure 10:
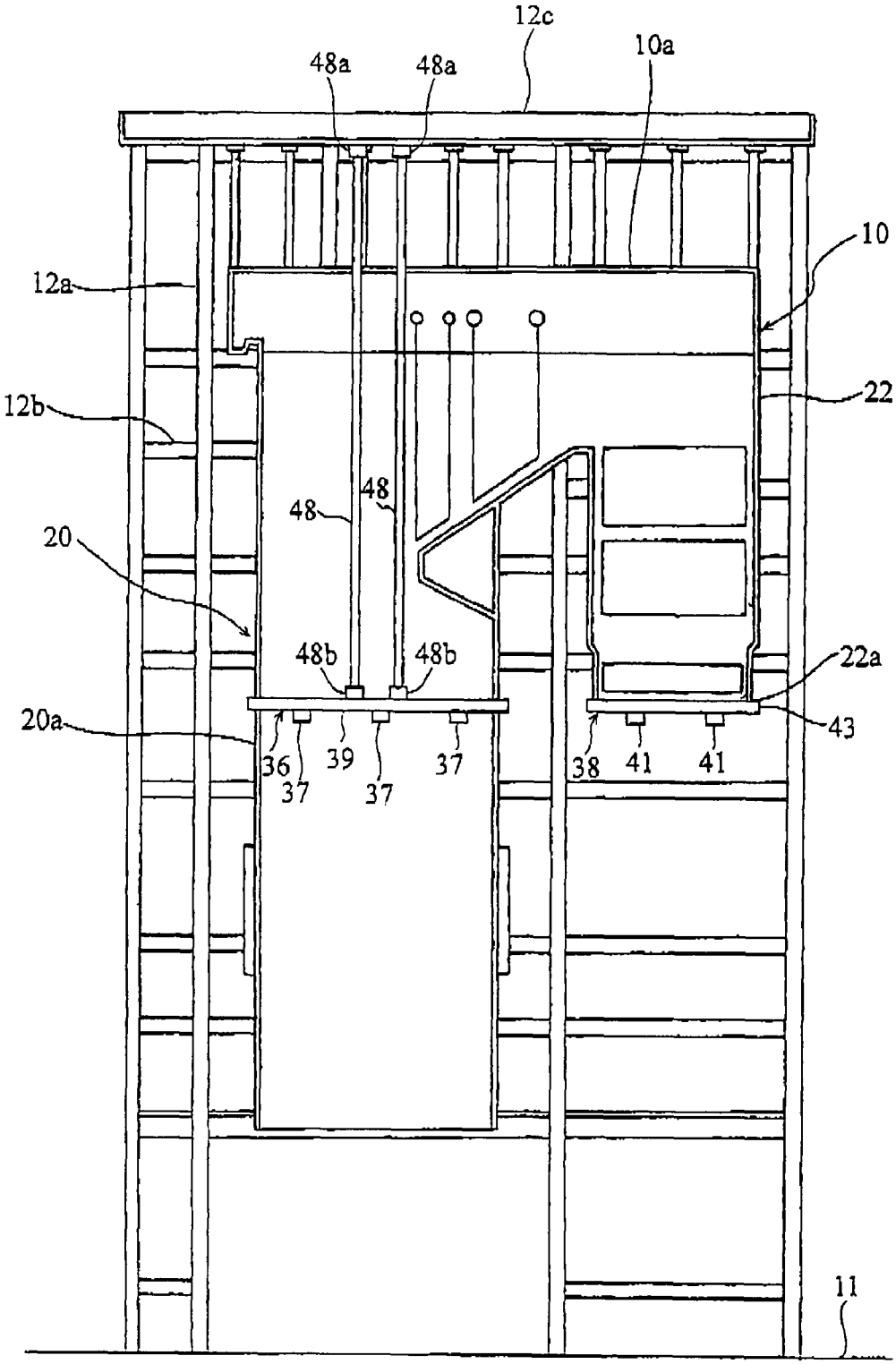
FIG. 10 is a diagram for showing a boiler and a supporting structure, with struts as reinforcing members being installed thereto.

FIG. 10 is a schematic diagram of the boiler 10 and the boiler building 12, including struts 48*a* as reinforcing members. The struts 48*a* extend in a vertical direction with one end 48*a* being fixed on the main girder 12*c* of the boiler building 12, and the other end 48*b* being fixed on the bar 39 in the first support 36.

It is possible to prepare the struts 48*a* from various materials. In particular, a metal material with a large rigidity such as iron is preferably used. The struts 48 stretch between the main girder 12*c* and the first support 36, and increase the resistance of the first support 36 against the force applied by the jack 40. Consequently, the support 36 can further stably support the weight of the boiler 10.

Second Embodiment

FIGS. 11 to 14 are diagrams for explaining a method for disassembling a boiler and a supporting structure according to the present invention.

The specific feature of the second embodiment is that the boiler 10 is disassembled simultaneously with the boiler building 12. The explanation of the reference numerals is omitted, for the structures which are the same as those in the first embodiment.

Similarly to the first embodiment, the enlarged opening 30 is prepared in the furnace unit 20, after the gas duct 26 is removed (enlarged opening forming step). Thereafter, connection bars 53 (FIG. 15) are provided in the boiler building 12 so that the connection bars 53 extends over the column 12*a*, furnace unit 20 and heat recovery area 22. The connection bars 53 can be prepared from the same material as that for the previously described connection bars 51. The length of the connection bars 51 is longer than the width of the boiler building 12.

For installing the connection bar 53 in the boiler building 12, for instance, open 55, 57 and 59 are prepared in the boiler building 12, and a wall opening 45 and an opposing wall opening 46 are prepared in the wall 20*a* of the furnace unit 20. The openings 55, 57, 59, 45 and 46 are prepared at a height corresponding to the lower end of the heat recovery area 22. Furthermore, the openings 55, 57, 59, 45 and 46 are prepared so that the connection bars 53 are introduced to the boiler building 12 through the openings 55 and 57, and exit from through the boiler building 12 from the opening 59, via the wall openings 45 and 46. Namely, the wall opening 45 in the wall 20*a* oppose with the openings 55 and the 57 in the boiler building 12, and the wall openings 45 and 46 in the wall 20*a* oppose with each other. Then, the connection bars 53 are installed so as to penetrate the openings 55, 57, 59, 45 and 46. Then, the support bars 37 and 41 is welded on the connection bars 53 so as to extend in a perpendicular direction with respect to the connection bars 51.

Figure 14:
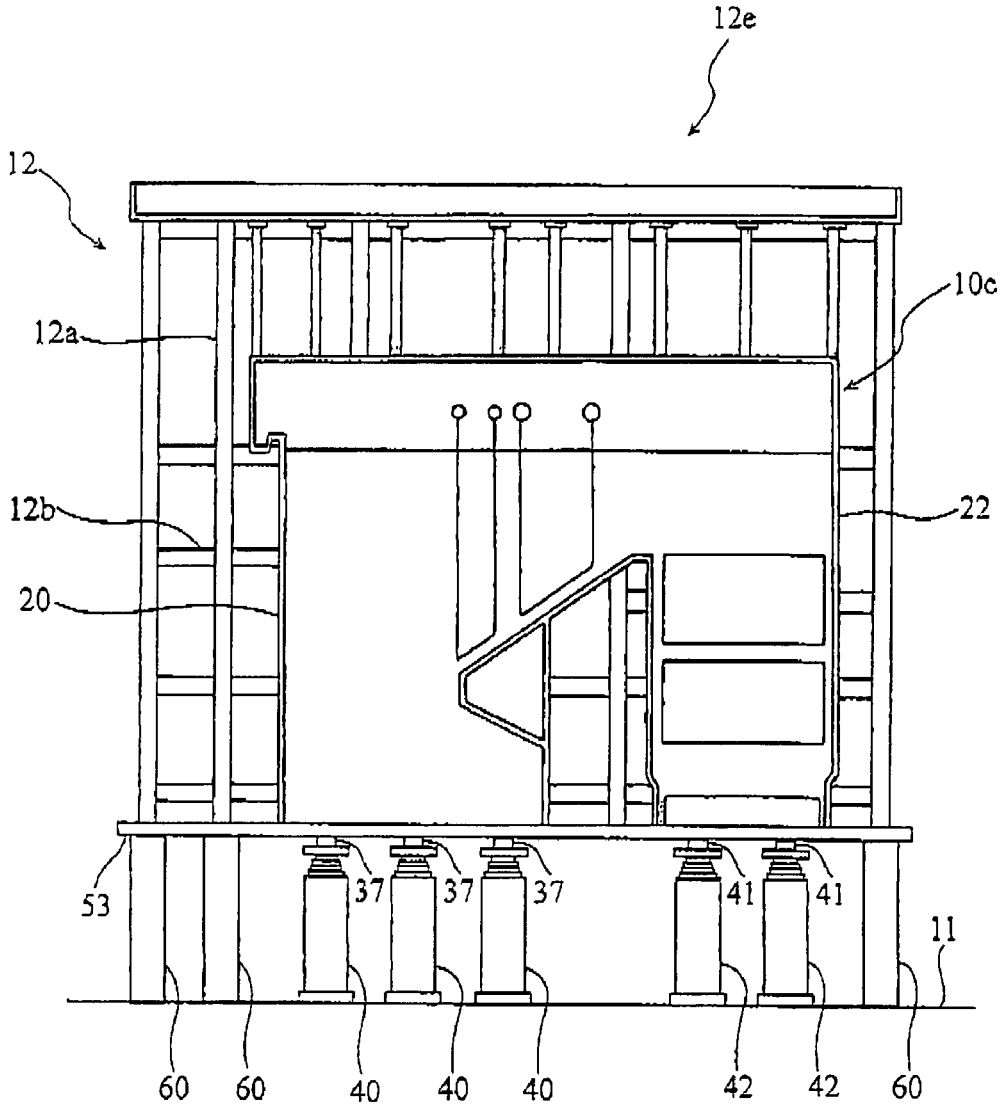
FIG. 14 is a diagram for showing an upper remaining part of the boiler and an upper remaining part of the boiler supporting structure.
Figure 15:
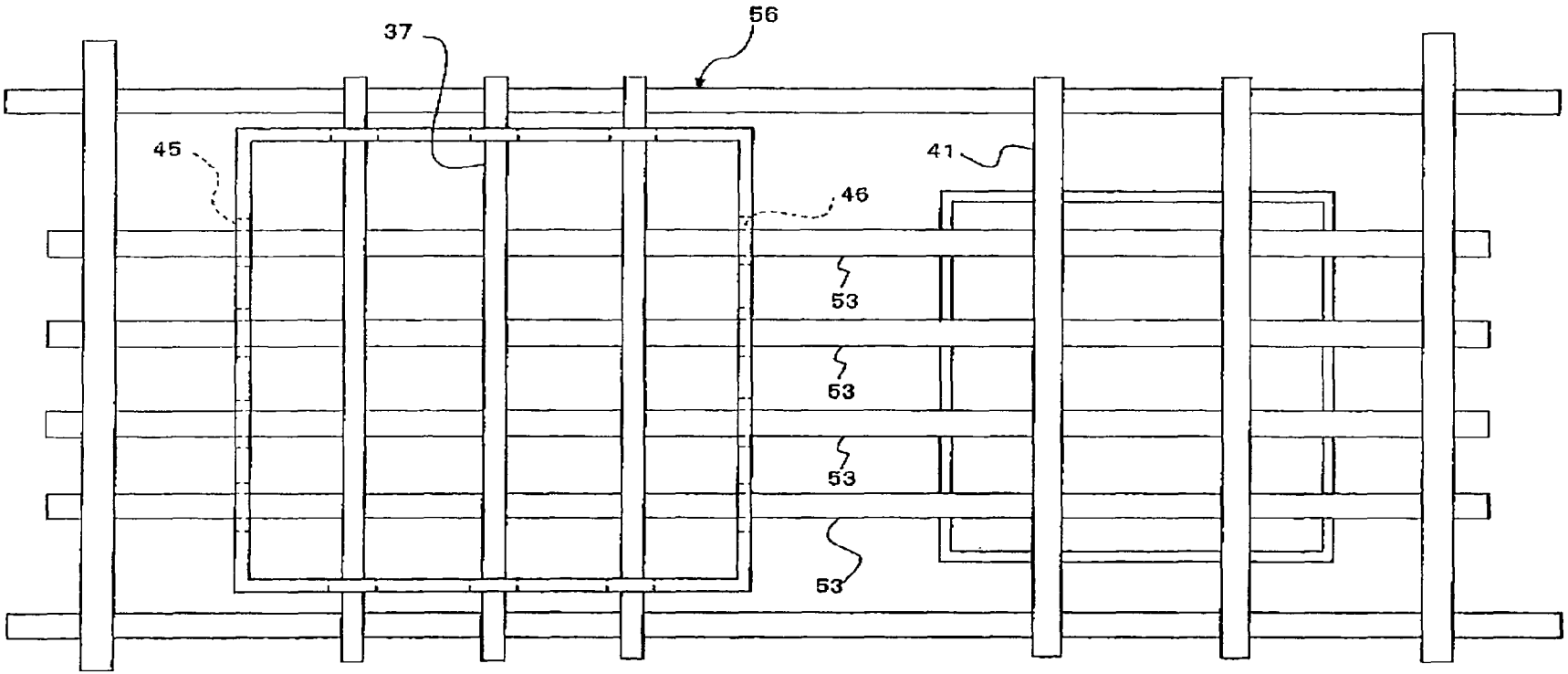
FIG. 15 is a diagram for explaining other configurations of the first and the second support to be used in a method for disassembling a boiler and/or a supporting structure according to the present invention.

FIG. 15 is a schematic bottom view of the first and the second supports 36 and 38. In the second embodiment, the first support 36 for the furnace unit 20 is formed by providing the connection bars 53 and the support bars 37 so as to make a right angle with respect to each other (first support installation step). Moreover, the second support 38 for the heat recovery area 22 is formed by providing the connection bars 53 and the bars 34 so as to make a right angle with respect to each other (second support installation step). For fixing the connection bars 53 to the boiler building 12, it is possible that the ends of the connection bars 53 are welded in advance to the previously fabricated welding-reinforcing bars 56, which are not shown in FIGS. 11 to 14.

After the jacks 40 and 42 are installed, the extendable parts 40*a* and 42*b* are brought into contact with the bars 37 and 41 in the first and the second support 36 and 38, respectively. The first and the second supports 36 and 38 and the connection bars 53, which are supported by the jacks 40 and 42, support the entire weight of the boiler 10 and the boiler building 12 (boiler and supporting structure supporting step).

Figure 11:
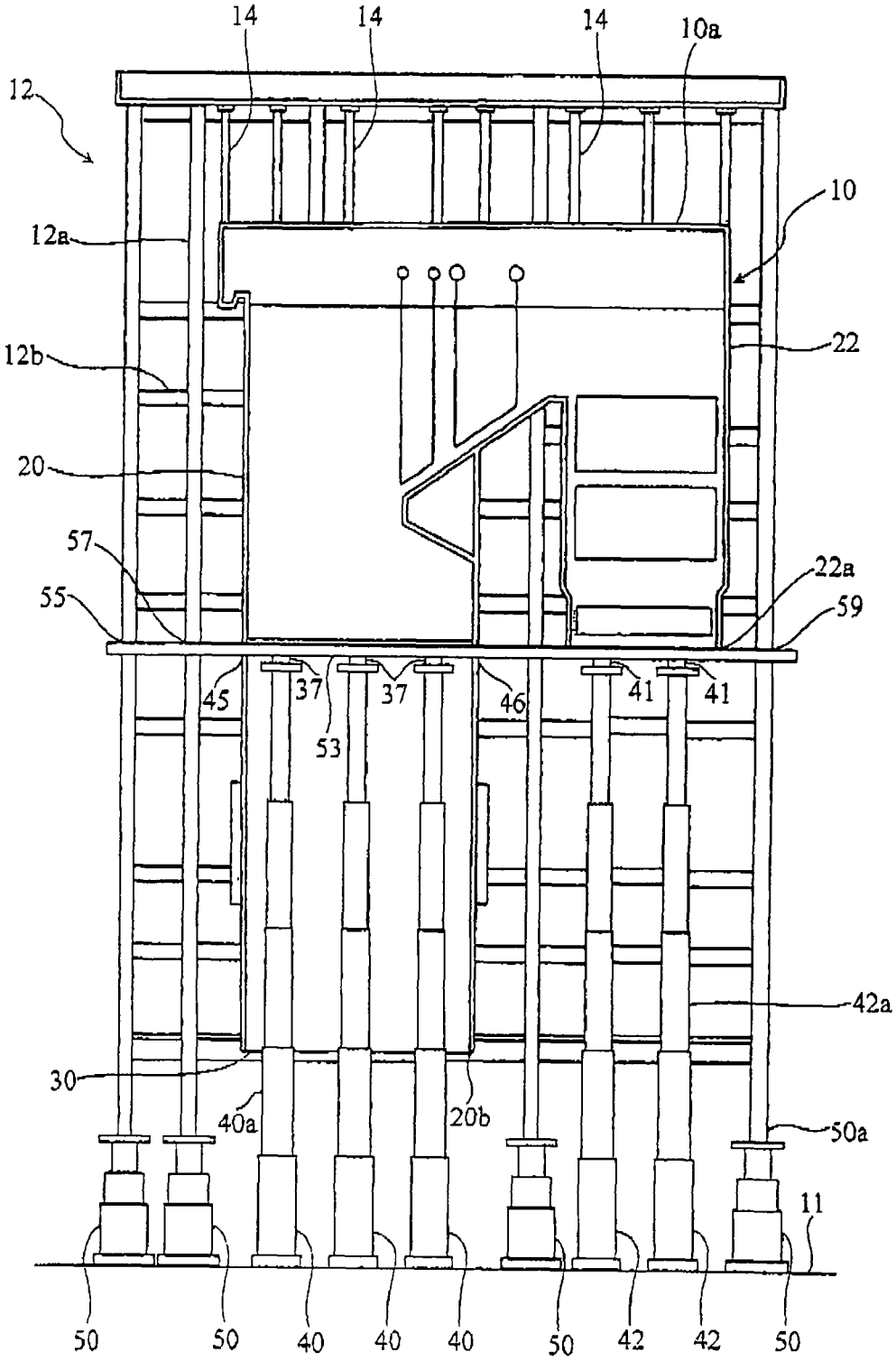
FIG. 11 is a diagram for explaining a support installation step and a boiler supporting step in a method for disassembling a boiler and a supporting structure according to the present invention.

As shown in FIG. 11, it is possible to additionally use jacks 50 for stably supporting the boiler building 12, when necessary. The jacks 50 have a shorter stroke comparing to that of the jacks 40 and 42, and are used for attaining a supplemental support. The jacks 50 can be used after the bottom part of the boiler building 12 is partially disassembled. The jacks 50 have approximately the same configuration as those with jacks 40 and 42. Extendable parts 50*a* of the jacks 50 extend to have a length of several meters.

Figure 12:
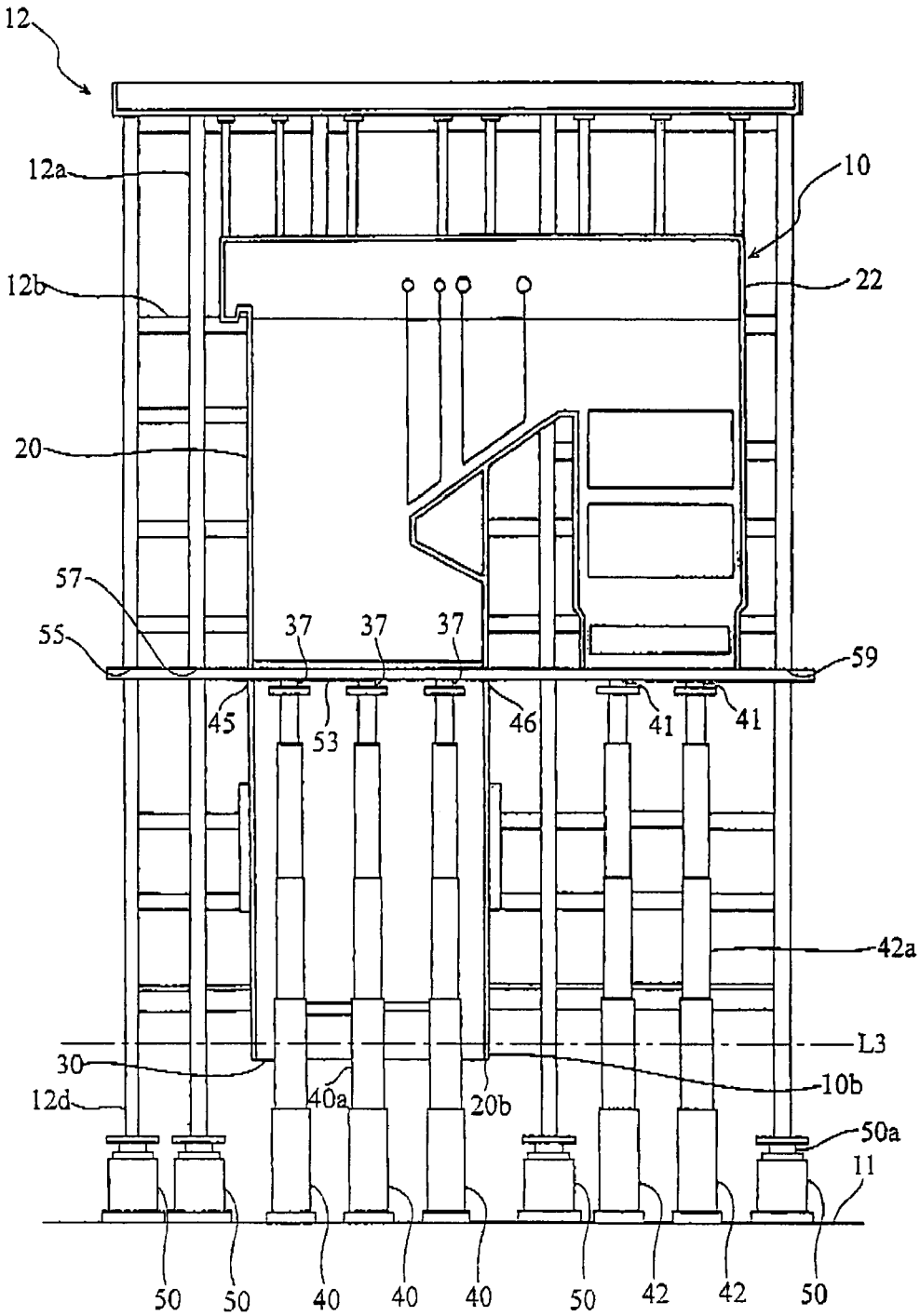
FIG. 12 is a diagram for explaining a lowering step in a method for disassembling a boiler and a supporting structure according to the present invention.

As shown in FIG. 12, it is possible that the extendable parts 50*a* of the jacks 50 (shorter jacks) are contracted, approximately simultaneously with the extendable parts 40*a* and 42*a*. Accordingly, the boiler 10 and the boiler building 12 are lowered. When the lower end 20*b* of the furnace unit 20 is lowered to a level close to the ground 11, the lowering operation is temporally suspended. In this state, the lower part 10*b* of the boiler 10 (a part of the furnace unit 20) and a lower part 12*d* of the boiler building 12, which are lower than dash-dotted line L3, are cut off by an operator on the ground 11.

Figure 13:
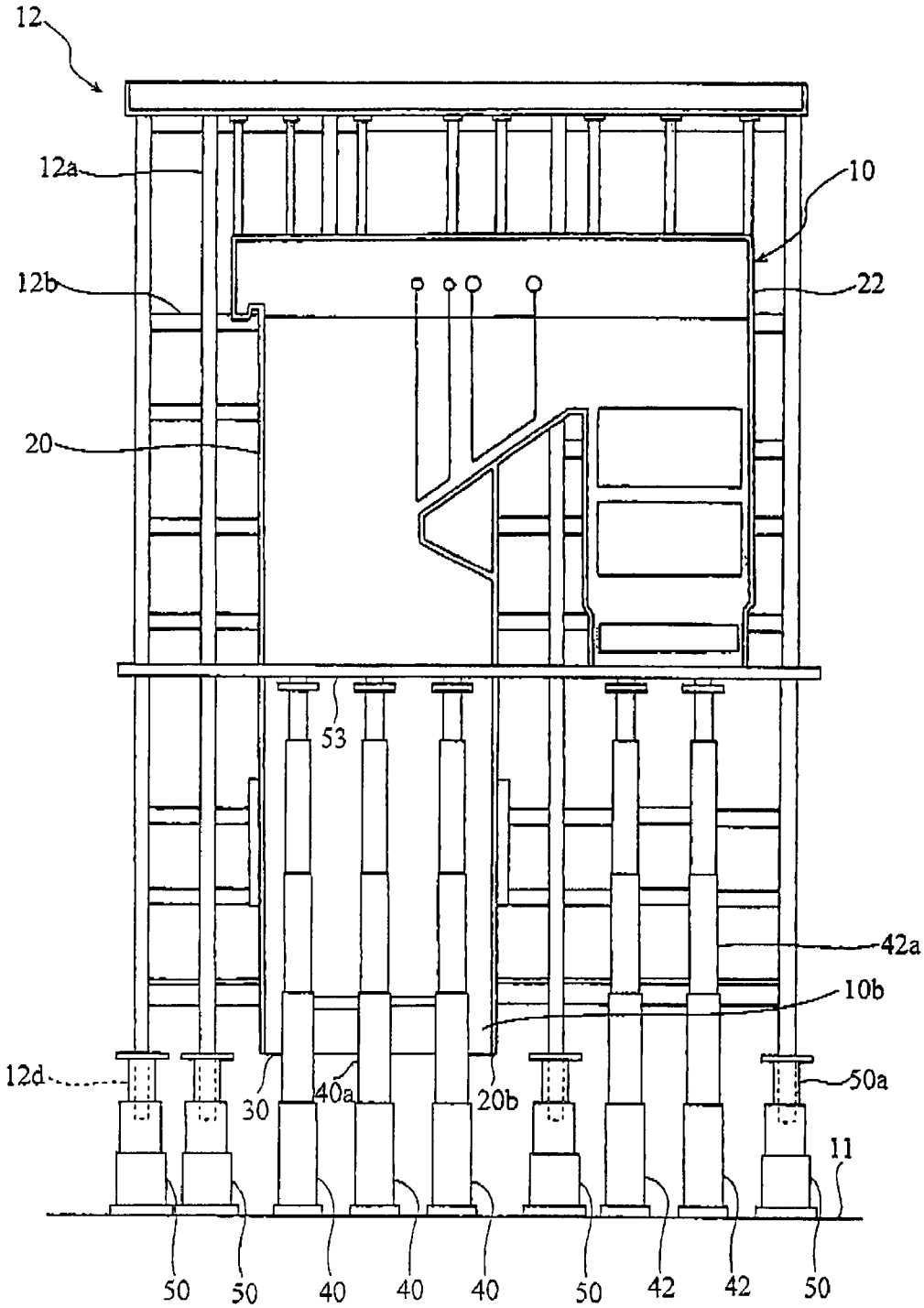
FIG. 13 is a diagram for explaining a state where a lower part of a boiler supporting structure is supported by jacks.

After completing the cutting off operation with respect to the parts 10*b* and 12*d* which are lower than line L3, the extendable parts 50*a* of the jacks 50 are extended again until the extendable parts 50*a* contact the cut ends of the lower part 12*b* of the boiler building 12, as shown in FIG. 13. The lower ends of the columns 12*a* are spaced apart from the connection bar 53.

The above described operation with respect to the part 12*b* supported by the jacks 50 is carried out successively. In other words, some of the lower parts 12*d*, which are in the state shown in FIG. 12, are partially cut off in the first place. Then, the length of the extendable parts 50*a* of the jacks 50, which are provided right below the cut ends of the boiler building 12, is increased. Thus, the jacks 50 are brought into contact with the cut ends for supporting the same.

Thereafter, some other lower parts 12*d* are partially cut off, and the jacks 50 are adjusted so that the length of the extendable parts 50*a* below the cut end is increased. Namely, the cutting operation and the supporting operation with respect to the cut ends are alternately carried out.

The boiler 10 and the boiler building 12 are lowered again to a position for the subsequent operation, and the lower part 12*d* is removed. The lowering and cutting operations can be repeated until the boiler 10 and the boiler structure 12, which are lower than the connection bar 53, are disassembled (lowering and disassembling step).

FIG. 14 shows that the upper remaining part 10*c* of the boiler 10 and the upper remaining part 12*e* the boiler building 12 have been lowered close to the ground 11, after completing the lowering and disassembling step. Accordingly, it is possible to disassemble the upper remaining parts 10*c* and 12*e* by a heavy machine or the like, in the same way with respect to the buildings (remainder disassembling step). For stably maintaining the upper remaining parts 10*c* and 12*e* on the jacks 40 and 42, it is possible to use stands 60 for supporting the end of the connection bars 53.

Based on the second embodiment, it is possible to simultaneously disassembly both the boiler and the boiler building. Therefore, the entire disassembling operation can be effectively carried out in a short period of time, without disassembling the two structures in serial.

Furthermore, it is possible to use struts 48 as shown in FIG. 10, for increasing the resistance of the support against the jack 40.

Third Embodiment

The third embodiment of the invention will be explained below by referring to FIGS. 16A, 16B, 17A and 17B, which are diagrams for explaining the procedure for carrying out the method for disassembling the boiler 10 and the boiler building 12 according to the present invention. In the figures, a plurality of first jacks 70 and a plurality of second jacks 72 are used as jacking apparatuses for disassembling the boiler 10 and the boiler building 12. The boiler building 12 comprises 9 stages of beams (lowest beams 12*b*-1 to the top beams 12-9).

Figure 16B:
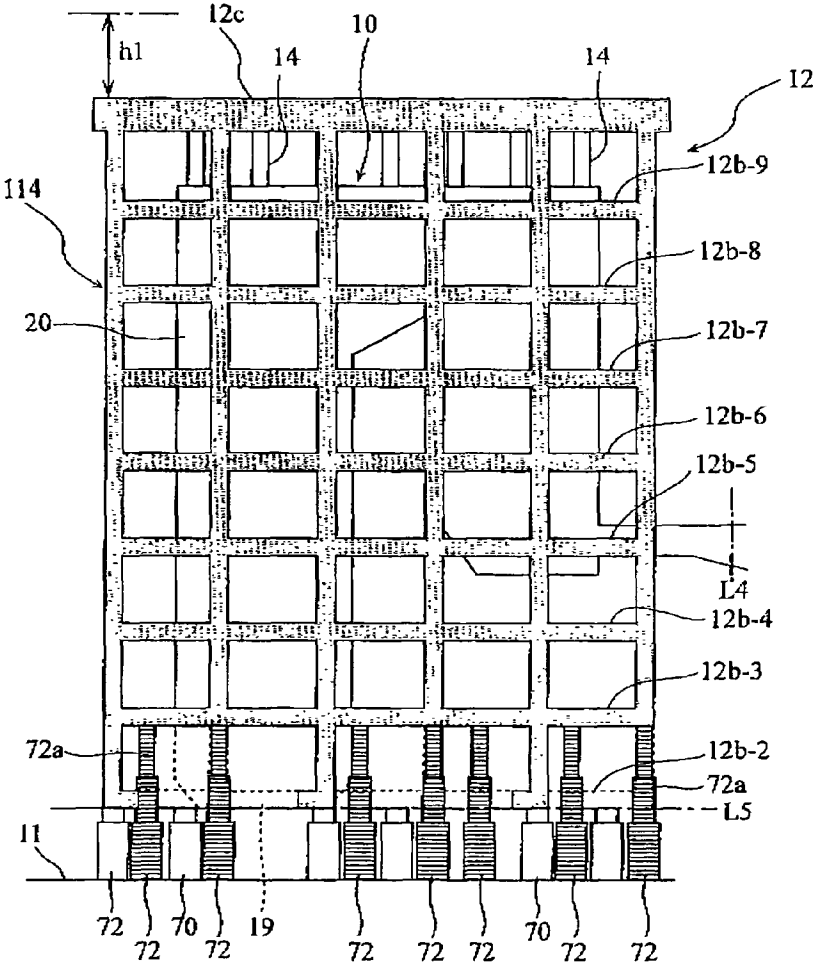
FIG. 16B is a diagram for showing a boiler and a supporting structure which have been subjected to a supporting step in a recurrent operation in a method for disassembling a boiler and a supporting structure according to the present invention.
Figure 16A:
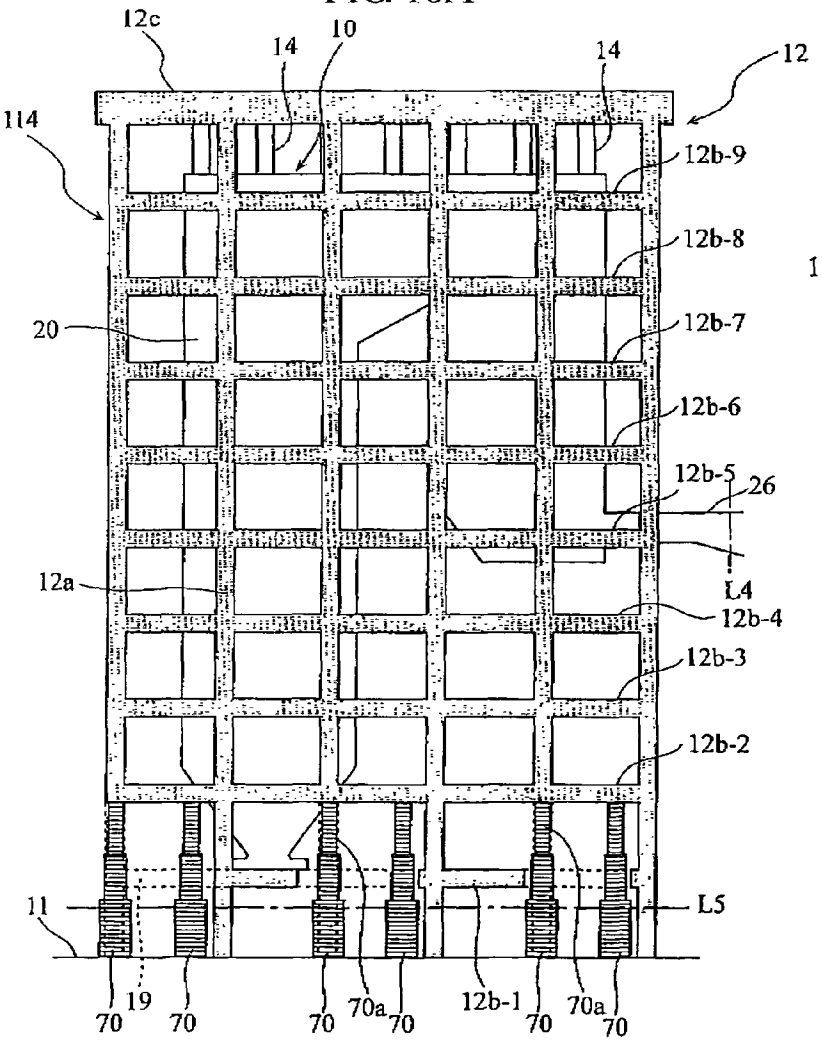
FIG. 16A is a diagram for explaining a detaching step and a supporting step included as earlier steps in a method for disassembling a boiler and a supporting structure according to the present invention.

FIG. 16A is a diagram for showing a boiler 10 and the boiler building 12 after a first step, i.e., a detaching step and a subsequent step, i.e., a supporting step. The boiler 10 before disassembling is connected with an external equipment (not shown) which is supposed to exist on the right side in FIG. 16A. In the detaching step, a gas duct 26 which connects the boiler 10 with the external equipment is cut off along a portion shown by dash-dotted line L4 by using a burner or the like.

In the supporting step, the boiler building is partially cut as shown by a dotted line to form a removed part 19. Then, a plurality of jacks 70 are dispersedly arranged on a base surface 11 for installing the boiler building 12 thereon. The jacks 70 are provided immediately below the columns 12*a* or beams 12*b* for supporting the boiler and the boiler building in a well-balanced state. The supporting position of the boiler building 12 and the boiler 10 is determined only by the arrangement of the jacks 70 provided below.

Thereafter, the jacks 70 are adjusted so as to support the boiler 10 and the boiler building 12. Namely, the length of the extendable parts 70*a* of the jacks 70 is extended for lifting up the entire structures including the boiler 10 and the boiler building 12 to a predetermined height. For this operation, for instance, the number of jacks 70 is, for instance, in the range of 10 to 40, depending on the size of the boiler building 12. The jacks 70 are adjusted to support the structure 12 usually at a supporting height of several meters, from the installation base. In FIG. 16A, the jacks 70 are extended to have a supporting height corresponding to the lower surface of the beam 12*b*-2.

In this state, the extendable parts 70*a* of the jacks 70 are extended upwardly for bringing the jacks 70 into a pressure contact with the lower surface of the beam 12*b*-2, and the lower end of the columns 12*a* obtained by removing the part 19. Thus, the supporting step is completed. At this point of time, the boiler building 12 is stably supported by the jacks 70. Six jacks 70 can be viewed from the front side of the boiler building 12, as shown in FIG. 16A. However, the total number of the first jacks 70 to be provided for the boiler building 12 in this embodiment is 20.

Thereafter, a removal step and a lowering step are carried out. In the removal step, a removal operation is carried out from lower parts of the boilers 10 and the boiler building 12, which are supported by the jacks 70. More concretely, the boiler 10 and the boiler building 12 are cut at the height shown by dash-dotted line L5 in FIG. 16A (1 to 2 meter height from the base surface 11) by using an equipment such as a gas burner.

After removing the parts below line L5, the boiler 10 and the boiler building 12 are still being upheld by the jacks 70, and the parts lower than the line L5 do not exist any more. In this state, a lowering step is carried out. Differently from the supporting step, the lowering step is carried out by lowering all the jacks 70 at the same rate simultaneously. Namely, the supporting height of the boiler 10 and the boiler building 12 is lowered by contracting/shortening all the extendable parts 70*a* of the jacks 70. During this operation, it is necessary to maintain the supporting balance of the boiler 10 and the boiler building 12 on the jacks 70. It is preferable to carry out the lowering step so as to have a predetermined space from the lower end (cut end) of the boiler 10 and the boiler building 12 to the base surface 11.

Thereafter, the removal step is carried out with respect to the lowered structures. After the first jacks 70 are contracted to a maximum extent to obtain a lowest supporting height, second jacks 72 are provided.

FIG. 16B shows that the lower surface of the beam 12*b*-2 is supported by the jack 70 at the lowest supporting height (L5). Besides the support by the first jacks 70, the second jacks 72 are provided for supporting the boiler building 12 by pressing the jacks 72 to the lower surface of the beam 12*b*-3 (additional supporting operation). Then, a part of the boiler building 12 which is lower than the beam 12*b*-3 is removed (removal step), and the jacks 72 are lowered.

In the additional supporting operation, the second jacks 72 are arranged below the boiler 10 and the boiler building 12 for obtaining a stable support with a good weight balance. While a part of the boiler structure is cut so as to form a removed part 19 corresponding to each one of the second jacks 72, the relevant extendable part 72*a* is extended.

After the additional supporting operation, the removal step and the lowering step are repeated until the jacks 72 are lowered to a maximum lowest position. The jacks 70 used in the supporting step shown in FIG. 16A are still located at the initially installed portions, with the extendable parts 72 being contracted. These jacks 70 are now used for a further supporting operation. After the lowering operation and the removal operation with the jacks 70, a further supporting operation with the jacks 72 follows. In this way, alternating support is made by using jacks 70 and 72 successively (alternating supporting step).

Figure 17B:
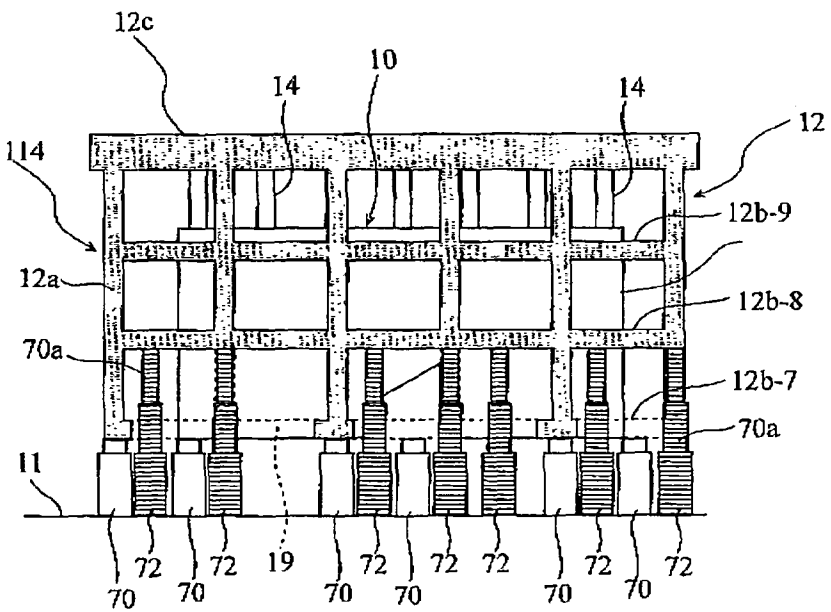
FIG. 17B is a diagram for showing a boiler and a supporting structure which have been subjected to a supporting step, following an removal step and a lowering step performed after the supporting step shown in FIG. 17A.
Figure 17A:
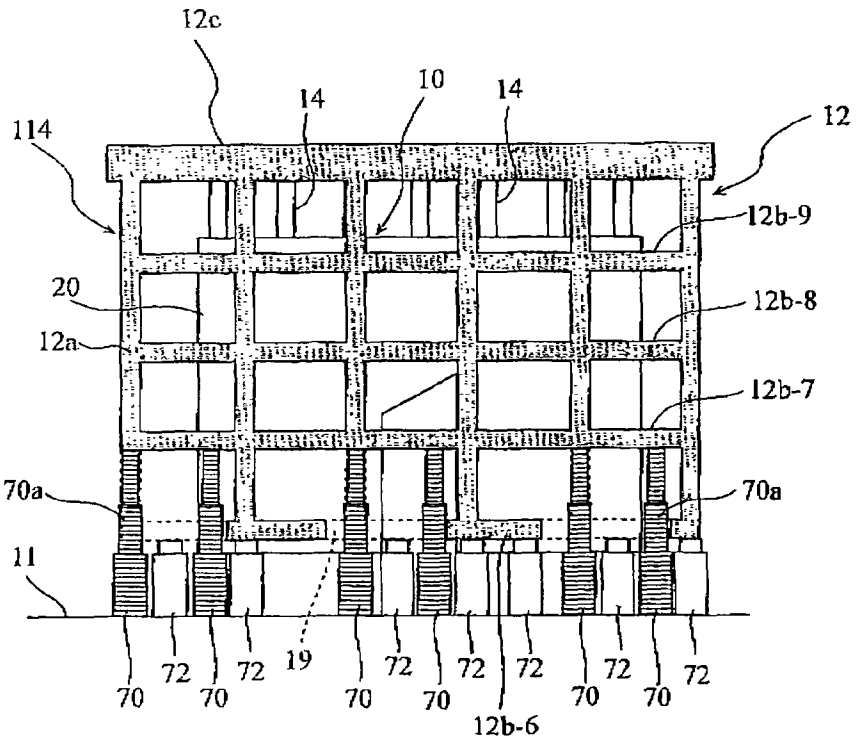
FIG. 17A is a diagram for showing a boiler and a supporting structure which have been subjected to a supporting step in a recurrent operation in a method for disassembling a boiler and a supporting structure according to the present invention.

FIGS. 17A and 17B show a state where the disassembling operation with respect to the boiler 10 and the boiler building 12 has progressed by the repetition of the alternating supporting step, removal step, and lowering step. FIG. 17A shows that the support by the jacks 72 is replaced by the support by the jacks 70 in the course of the disassembling operation. After the removal step and the lowering step performed to the boiler parts supported by the jacks 70, an additional supporting step is further carried out by using the jacks 72. Both the boiler 10 and the boiler building 12 are subjected to the disassembling operation in parallel by repeating the alternating supporting step by using the first jacks 70 and the second jacks 72, and the removal step and lowering step.

Between two adjacent supporting steps, it is possible to carry out one or more removal step and one or more lowering step. Moreover, it is possible for the extendable part 70*a* of the jack 70 to support not only the columns 12*a* and the beams 12*b*, but also one or more supporting elements which has been provided on the supporting structure.

The operation of the jacks 70 and 72 can be carried out individually. Moreover, it is possible to provide a control unit for controlling all the jacks collectively. By using the control unit, it is possible to perform a simultaneous lowering operation in all the lowering steps, or to make individual supporting operation, and to precisely control the additional supporting operation.

Moreover, it is possible to change the number or kind of first and second jacks. Namely, it is possible to use only one kind of jacks (jacks 70 or jacks 72), or two or three kinds of jacks, depending on the size of the boiler and the boiler building to be disassembled.

According to the third embodiment of the present invention, it is possible to quickly disassemble the boiler 10 and the boiler building 12 as a simultaneous operation. Then, it is not necessary to disassemble the boiler 10 and the boiler building 12 one after another. The disassembling operation proceeds from lower parts of the boiler 10 and the boiler building 12. This makes it possible to perform the cutting operation at a height close to the base surface 11 such as a ground, and almost no operation is conducted at an elevated spot. Accordingly, the disassembling operation is carried out safely. Moreover, it is not necessary to bring down the cut parts of the boiler 10 and the boiler building 12 from an elevated spot. Therefore, the cut parts can be easily transported from the disassembling site. Thus, the cut parts can be easily and cheaply disposed.

Moreover, in the third embodiment of the invention, it is possible to support the boiler building 12 easily by using the jacks 70 with extendable parts 70*a*. Further, the supporting height is easily changed only by adjusting the extendable parts 70*a*. Only by the vertical extension and contraction of the extendable parts 70*a*, the boiler 10 and the boiler building 12 can be stably supported, and vertically moved. Therefore, the operation can be carried out in a limited space, i.e., within the installation site of the boiler 10 and the boiler building 12.

Furthermore, in the third embodiment, it is possible to carry out a plurality of supporting steps by using jacks 70 and 72. Therefore, the individual jacks can be relatively small and light, which are convenient in view of installation and portability.

Fourth Embodiment

Figure 18B:
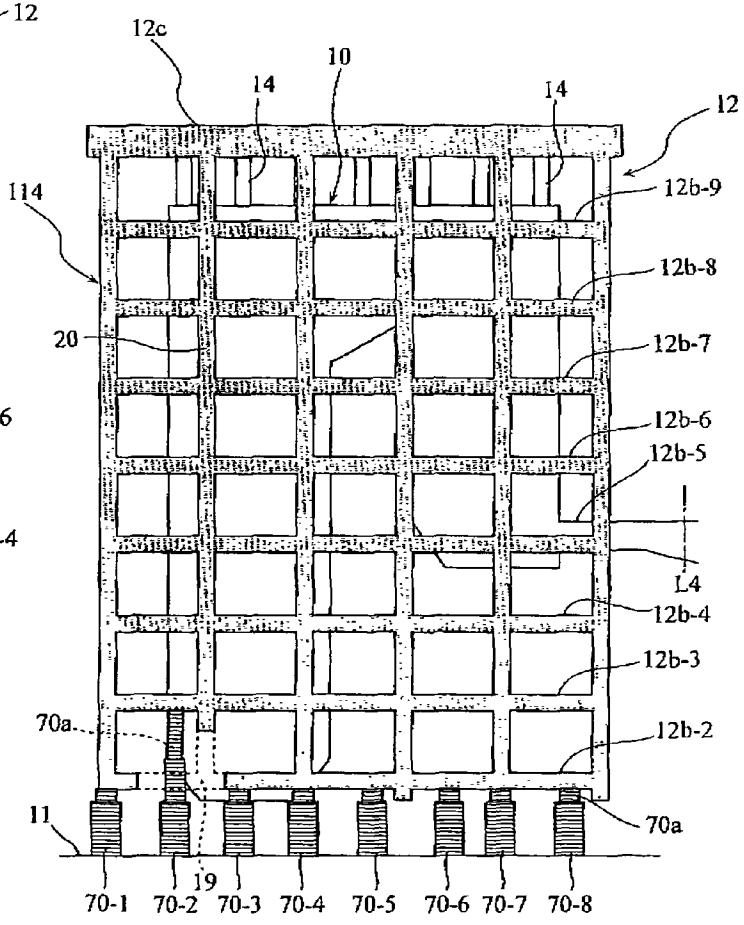
FIG. 18B is a diagram for showing a boiler and a supporting structure which have been subjected to an operational step, following an removal step and a lowering step performed after the supporting step shown in FIG. 18B.
Figure 18A:
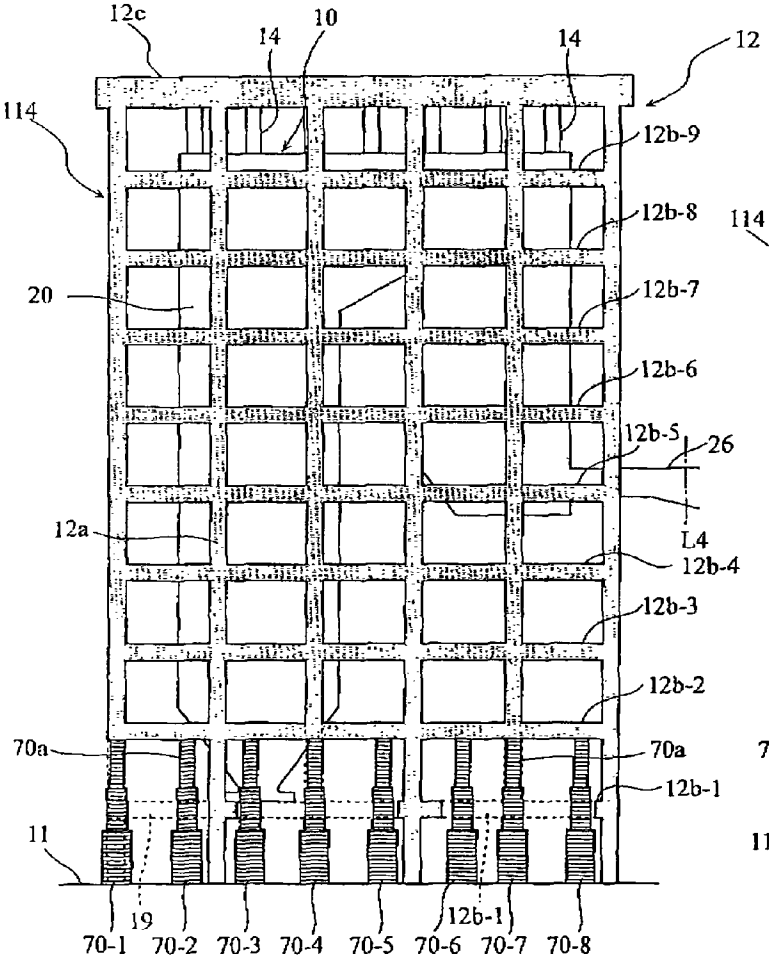
FIG. 18A is a diagram for explaining a supporting step included in a method for disassembling a boiler and a supporting structure according to the present invention.

FIGS. 18A and 18B are diagrams for explaining the operations in the present invention. In the figures, the explanation of the reference numerals is omitted, for the structures which are the same as those in the previously explained FIGS. 17A and 17B. In the fourth embodiment, only one kind of jacks is used for carrying out all the steps in the method for disassembling a boiler and a suspending structure. A plurality of first jacks 70 (jacks 70-1 to 70-8 in the figures) is used. The number of jacks 70 is increased comparing to each of first jacks and second jacks described in relation to FIG. 16A or 16B.

FIG. 18A is a diagram for describing a supporting step. After a detaching step, which was described relating to FIG. 16A, the jack 70 are provided on a base surface 18 on which the boiler 10 and the boiler building 12 are provided. Extendable parts 70*a* of the jacks 70 are extended for supporting the boiler building 12. Similarly to the embodiment in FIG. 16A, one or more of the beam 12*b*-1 are partially removed to produce a removal part 19. Then, the upper ends of the extendable parts 70*a* are pressed against the lower surfaces of the beams 12*b*-2 and the column 12*a* so that the boiler building is supported. In the following removal step, parts of the boiler 10 and the boiler building 12, which are lower than the beam 12*b*-1, are cut off. Then, the boiler 10 and the boiler building 12 are lowered to a maximum extent (lowest descent position) in the lowering step.

FIG. 18B shows the boiler 10 and the boiler building 12 after completing the removal step and the lowering step described above. In the figure, a lower part of the boiler building 12, that is lower than the beam 12*b*-2 supported by the jack 70, has been removed.

In the fourth embodiment, a lower part of the boiler supporting building 12, for example, a part of the beam 12*b*-2 supported by one of the jacks 70 (jack 70-2) is partially removed, to create another removed part 19 (partial removal operation).

Thereafter, the length of the extendable part 70*a* of the jack 70-2 is increased to the lower surface of the beam 12*b*-3, whereby the beam 12*b*-3 is supported by the jack 70-2 again (supporting step in a recurrent operation). Likewise, the supporting height of the jacks 70 except for the jack 70-2 is increased, for example, one after another. The supporting step in the recurrent operation is carried out by adjusting one or more the jacks at one time, with maintaining a stable supporting state. The supporting step in the recurrent operation is repeated until all the jacks 70 are subjected to this step. Subsequently, the removal step and the lowering step are repeated. Thus, the boiler 10 and the boiler building 12 are completely disassembled by using the first jacks 70, without using the second jacks 72.

For performing the above described operation, relatively large number of jacks is used. It is possible to gradually decrease the number of jacks as the total weight of the boiler 10 and the boiler building 12 is decreased after the disassembling operation proceeds to a predetermined extent.

In the above embodiment, small and identical jacks 70 can be used for disassembling the boiler 10 and the boiler building 12 simultaneously, from the lower parts of the boiler 10 and the structure 12. It is possible, in the present invention, to easily and speedily carry out the disassembling operation with respect to the boilers and the boiler buildings with various sizes.

On the other hand, it is possible to use jacks having extendable parts which are longer than those of the jacks 70 shown in FIG. 16A. When such large jacks are used, the extendable parts can be extended more, comparing to those of the small jacks. Therefore, a tall boiler 10 and boiler building 12 can be treated over wide range with respect to height, even by a single supporting step and the following removal step and lowering step. Thus, the disassembling operation can be expedited.

Moreover, when a relatively small boiler and a suspending structure are disassembled with the large jacks, it is possible to directly support the main girder 12*c* of the boiler building for the supporting step. In this case, it is possible to completely disassemble the boiler 10 and the boiler building 12 by repeating the removal step and the lowering step only, after a single supporting step.

In the removal step, it is preferable that the interior of the boiler part, which has not yet been disassembled, has a negative pressure. Accordingly, it is possible to avoid damages caused by a harmful cut substance. For providing a negative pressure within the boiler 10, open parts of the boiler is first closed by closure members. Then, an apparatus including a piping for air suction is provided at an appropriate position of the boiler, and then the air in the boiler 10 is absorbed through the piping for air suction by using, for example, a fan. By using a fan, it is possible to obtain a large absorption toward the interior of the boiler 10.

It is possible, in a general disassembling operation, that powder (e.g. metal powder or powder of fire-resistant substance such as asbestos) is formed when the boiler part such as the outer or inner casing 27*a* and 27*b* of the furnace unit 27 is cut. By the application of negative pressure in the present invention, the powder can is retained in the interior of the boiler 10, and is not released to the outside environment. Accordingly, it is possible to eliminate possible environmental problems which can be caused by harmful powder.

For closing the open parts of the boiler, it is possible to utilize the base surface 11. More specifically, the boiler 10 is lowered, after the lower part of the furnace unit is cut off, until the lower edge contacts the base surface 11. Then, the opening of the boiler is at least partially closed with the base surface 11.

Moreover, it is preferable to wrap the lower end of the boiler 10 by using a wrapping member such as a plastic sheet. By the provision of the wrapping member, it is possible to prevent a part of the boiler 10 such as a fire resistant material including asbestos from falling, or a small cut pieces or powder of the boiler 10 from scattering.

The present invention being thus described, it will be clearly understood that the same may be varied in many ways. Such variations are not to be regarded as a departure from the spirit and scope of the present invention, and all such modification as would be easily understood to one skilled in the art are intended to be included within the scope of the appended claims.

What is claimed is:

1. A method for disassembling a boiler suspended from and supported by a supporting structure, the boiler comprising a furnace unit and a heat recovery area arranged in parallel with the furnace unit, both the furnace unit and the heat recovery area extending in a vertical direction and a lower end of the furnace unit being situated lower than a lower end of the heat recovery area, comprising:

cutting off a lower part of the furnace unit to prepare an enlarged opening in the furnace unit;

fixing a first support to the furnace unit approximately at the same height as the lower end of the heat recovery area;

fixing a second support to the lower end of the heat recovery area;

providing a first jacking apparatus and a second jacking apparatus respectively, under the first support and the second support so that the entire weight of the boiler is supported by the first jacking apparatus and the second jacking apparatus;

detaching the boiler from the supporting structure;

lowering the first support and the second support by the first jacking apparatus and the second jacking apparatus, and disassembling the boiler by cutting a lower part of the boiler, and repeating the lowering and the disassembling of the boiler until the first support and the second support are lowered to a maximum extent; and disassembling a remaining upper part of the boiler.

2. The method of claim 1, wherein each of the first support and the second support has a lattice configuration made by interconnecting support bars.

3. The method of claim 1, wherein the first support and the second support are connected by a connection bar which extends over the first support and the second support.

4. The method of claim 1, which further comprises: providing a strut which extends between a main girder of the supporting structure located above the furnace unit and the first support, for imparting a resistance to the first support against the force applied by the first jacking apparatus.

5. A method for disassembling a boiler and a supporting structure, the boiler being suspended from the supporting structure, the boiler comprising a furnace unit and a heat recovery area arranged in parallel with the furnace unit, both the furnace unit and the heat recovery area extending in a vertical direction and a lower end of the furnace unit being situated lower than a lower end of the heat recovery area, comprising:

cutting off a lower part of the furnace unit to prepare an enlarged opening in the furnace unit;

fixing a support to the furnace unit and the heat recovery area approximately at the same height as the lower end of the heat recovery area so that the support horizontally extends over the supporting structure;

providing a jacking apparatus under the support so that the entire weight of the boiler and the supporting structure is supported by the jacking apparatus;

lowering the support by the jacking apparatus, and disassembling the boiler and supporting structure by cutting lower parts of the boiler and the supporting structure, and repeating the lowering and the disassembling until the support is lowered to a maximum extent; and disassembling a remaining upper part of the boiler and the supporting structure.

6. The method of claim 5, wherein the support has a lattice configuration made by interconnecting support bars.

7. The method of claim 5, which further comprises: providing a strut which extends between a main girder of the supporting structure and the support, for imparting a resistance to the support against the force applied by the jacking apparatus.

8. A method for disassembling a boiler and a supporting structure comprising a plurality of columns extending in a vertical direction and a plurality of beams extending in a horizontal direction for interconnecting the columns at different heights, the boiler being included in the supporting structure and suspended therefrom, the boiler being connected to external equipment provided around the supporting structure, comprising:

separating the boiler and the supporting structure from the external equipment;

providing a plurality of first jacking apparatuses below the columns and the beams of the supporting structure;

supporting the boiler and the supporting structure with the first jacking apparatuses at a first supporting height, the boiler and the supporting structure being supported from lower parts of the boiler and the supporting structure;

removing the cutting parts of the boiler and the supporting structure which are lower than the first supporting height, with the boiler and the supporting structure being stably supported; and lowering the boiler and the supporting structure by the first jacking apparatuses from the first supporting height after completing the removal step, and in a recurring operation, repeating the supporting step, the removal step and the lowering step for successively disassembling the boiler and the supporting structure from the lower parts of the boiler and the supporting structure.

9. The method of claim 8, wherein the columns and the beams of the supporting structure are made of steel.

10. The method of claim 8, wherein the first jacking apparatuses comprise extendable parts which extend and contract in a vertical direction, the boiler and the supporting structure being supported by increasing the length of the extendable parts and pressing upper ends of the extendable parts against lower surfaces of the columns and the beams of the supporting structure.

11. The method of claim 8, wherein the supporting step in the recurring operation is carried out by providing a plurality of second jacking apparatuses at a plurality of positions, for supporting the boiler and the supporting structure at a second supporting height which is higher than the first supporting height.

12. The method of claim 8, wherein the supporting step in the recurring operation comprises a first substep for removing lower parts of the boiler and the supporting structure which are supported by at least some of the first jacking apparatuses, to provide bottom edges of the boiler and the supporting structure which are not supported by the portion of the first jacking apparatuses, and a second substep for supporting the bottom edges of the boiler and the supporting structure by increasing the length of the extendable parts of said at least some of the first jacking apparatuses, the first substep and the second substep being repeated until all the jacking apparatuses are involved in the first substep and the second substep, and subsequently the removal step and the lowering step being repeated.

13. The method of claim 8, wherein said at least some of the first jacking is apparatuses which are utilized are less than all of the available first jacking apparatuses.

14. The method of claim 8, wherein the interior of the boiler is set to a negative pressure prior to the removal step.

* * * * *